US008770834B2

(12) United States Patent
Suzuki

(10) Patent No.: US 8,770,834 B2
(45) Date of Patent: Jul. 8, 2014

(54) THERMOSTAT DIAGNOSTIC APPARATUS

(75) Inventor: Hideyuki Suzuki, Yokohama (JP)

(73) Assignee: Nissan Motor Co., Ltd., Yokohama (JP)

( * ) Notice: Subject to any disclaimer, the term of this patent is extended or adjusted under 35 U.S.C. 154(b) by 51 days.

(21) Appl. No.: 13/382,194

(22) PCT Filed: Sep. 21, 2010

(86) PCT No.: PCT/IB2010/002364
§ 371 (c)(1),
(2), (4) Date: Jan. 4, 2012

(87) PCT Pub. No.: WO2011/039591
PCT Pub. Date: Apr. 7, 2011

(65) Prior Publication Data

US 2012/0106590 A1 May 3, 2012

(30) Foreign Application Priority Data

Sep. 30, 2009 (JP) ..... 2009-226995

(51) Int. Cl.
*G01K 15/00* (2006.01)
*G01N 25/72* (2006.01)
*G01M 15/00* (2006.01)

(52) U.S. Cl.
USPC ..... 374/1; 73/114.68; 374/4

(58) Field of Classification Search
CPC ..... F02D 41/18
USPC ..... 374/1, E15.001; 73/114.68
See application file for complete search history.

(56) References Cited

U.S. PATENT DOCUMENTS 6,076,964 A * 6/2000 Wu et al. ..... 374/141
6,101,442 A * 8/2000 Lewandowski et al. ..... 701/114
6,694,246 B2 * 2/2004 Masuda et al. ..... 701/114

(Continued)

FOREIGN PATENT DOCUMENTS

CN 1680797 A 10/2005
JP 2001-241327 9/2001

(Continued)

OTHER PUBLICATIONS

An English translation of the Japanese Office Action of corresponding Japanese Application No. JP 2009-226995, dated May 11, 2012, mailed May 22, 2012.

(Continued)

*Primary Examiner* — Lisa Caputo
*Assistant Examiner* — Nasir U Ahmed
(74) *Attorney, Agent, or Firm* — Global IP Counselors, LLP

(57) ABSTRACT

A thermostat diagnostic apparatus is provided with a cooling medium temperature sensor, an engine operating condition sensor and a malfunction diagnosing device. The malfunction diagnosing device is configured to diagnose a stuck-open malfunction of a thermostat provided in a coolant flow passage of an engine installed in a mobile body based on a comparison of a real cooling medium temperature detected by the cooling medium temperature sensor and an estimated cooling medium temperature estimated based on an engine operating condition of the engine detected by the engine operating condition sensor. The malfunction diagnosing device determines that the thermostat is stuck in an open state upon determining that either the estimated cooling medium temperature or the real cooling medium temperature exceeds a prescribed reference value during a period in which an increased heat exchange rate condition of a radiator is satisfied continuously.

6 Claims, 19 Drawing Sheets

(56) References Cited

U.S. PATENT DOCUMENTS

| | | | | |
|---|---|---|---|---|
| 6,695,473 | B2 * | 2/2004 | Unger et al. | 374/145 |
| 6,854,881 | B2 * | 2/2005 | Nada | 374/169 |
| 7,261,067 | B2 | 8/2007 | Kim | |
| 7,409,929 | B2 * | 8/2008 | Miyahara et al. | 123/41.05 |
| 7,455,920 | B2 * | 11/2008 | Sakai | 429/414 |
| 8,303,174 | B2 * | 11/2012 | Kasahara | 374/144 |
| 2004/0168510 | A1 * | 9/2004 | Wakahara et al. | 73/118.1 |
| 2007/0033998 | A1 * | 2/2007 | Wakahara et al. | 73/118.1 |

FOREIGN PATENT DOCUMENTS

| | | | |
|---|---|---|---|
| JP | 2001-329840 | | 11/2001 |
| JP | 58617 | U1 | 11/2006 |
| JP | 2007-40108 | | 2/2007 |
| JP | 2007-040108 | | 2/2007 |
| JP | 4385492 | B2 | 12/2009 |
| RU | 53728 | U1 | 5/2006 |
| SU | 659774 | A1 | 4/1979 |

OTHER PUBLICATIONS

An English translation of the Russian Office Action of corresponding Russian Application No. 2012104531, issued on Jan. 18, 2018.

A Written Opinion of the International Search Authority for International Application No. PCT/IB2010/002364, dated Dec. 27, 2010, mailed Jan. 11, 2011.

An English translation of the Russian Decision on Grant of corresponding Russian Application No. 2012104531/06 (006830), issued on May 7, 2013.

An English translation of the Chinese Office Action for the corresponding Chinese Application No. 201080037370.2, issued on Aug. 21, 2013.

* cited by examiner

THERMOSTAT DIAGNOSTIC APPARATUS

CROSS-REFERENCE TO RELATED APPLICATIONS

This application is a U.S. National stage of International Application No. PCT/IB2010/002364, filed Sep. 29, 2010, which claims priority to Japanese Patent Application No. 2009-226995, filed on Sep. 30, 2009. The entire disclosure of Japanese Patent Application No. 2009-226995 is hereby incorporated herein by reference.

BACKGROUND

1. Field of the Invention

The present invention generally relates to a diagnostic apparatus for a thermostat. More specifically, the present invention relates to a thermostat diagnostic apparatus for diagnosing if a vehicle's thermostat that is provided in a coolant flow passage of an internal combustion engine is malfunctioning.

2. Background Information

Various thermostat diagnostic apparatus have been proposed for diagnosing if a vehicle's thermostat of a cooling system is malfunctioning stuck in an open position. One example of such a thermostat diagnostic apparatus is disclosed in Japanese Laid-Open Patent Publication No. 2007-040108. In this patent publication, a thermostat diagnostic apparatus is provided for diagnosing if a vehicle's thermostat is malfunctioning. In particular, the thermostat diagnostic apparatus is configured to diagnose that a thermostat is stuck in an open position if the thermostat is in an open position either after a prescribed amount of time has elapsed since the vehicle was started, or after the engine has reached a prescribed warm-up state since being started.

SUMMARY

It has been discovered that with the technology disclosed in Japanese Laid-Open Patent Publication No. 2007-040108, a diagnosis based on a change in the coolant temperature often cannot be accomplished and even if a diagnosis is conducted using another method, the timing of completion is often late.

One object of the present disclosure is to provide a thermostat diagnostic apparatus that diagnoses a thermostat even before a prescribed amount of time has elapsed since the vehicle was started or before an engine has reached a prescribed warm-up state since being started.

In view of the state of the known technology, one aspect of the present disclosure is to provide a thermostat diagnostic apparatus that basically comprises a cooling medium temperature sensor, an engine operating condition sensor and a malfunction diagnosing device. The malfunction diagnosing device is configured to diagnose a stuck-open malfunction of a thermostat provided in a coolant flow passage of an engine installed in a mobile body based on a comparison of a real cooling medium temperature detected by the cooling medium temperature sensor and an estimated cooling medium temperature estimated based on an engine operating condition of the engine detected by the engine operating condition sensor. The malfunction diagnosing device determines that the thermostat is stuck in an open state upon determining that either the estimated cooling medium temperature or the real cooling medium temperature exceeds a prescribed reference value during a period in which an increased heat exchange rate condition of a radiator is satisfied continuously.

BRIEF DESCRIPTION OF THE DRAWINGS

Referring now to the attached drawings which form a part of this original disclosure.

DETAILED DESCRIPTION OF EMBODIMENTS

Selected embodiments will now be explained with reference to the drawings. It will be apparent to those skilled in the art from this disclosure that the following descriptions of the embodiments are provided for illustration only and not for the purpose of limiting the invention as defined by the appended claims and their equivalents.

Figure 1:
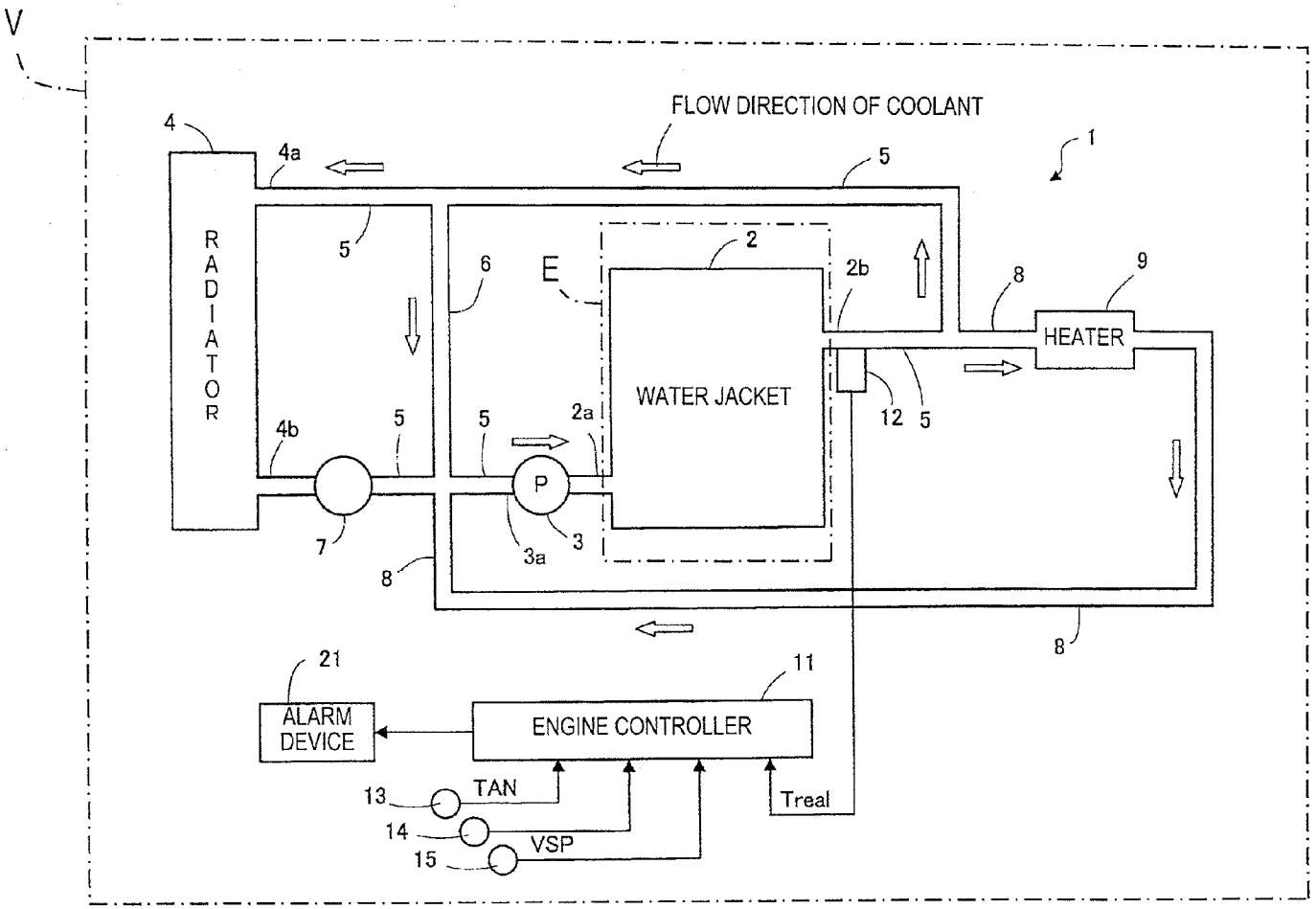
FIG. 1 is a schematic view of an engine cooling system or apparatus according to a first embodiment.

Referring initially to FIG. 1, an engine cooling apparatus or system 1 is schematically illustrated in accordance with a first embodiment. The engine cooling apparatus 1 basically comprises a water jacket 2, a water pump 3, a radiator 4, a coolant circulation passage 5, a first bypass passage 6 and a thermostat 7. Although only shown as a box in FIG. 1, the water jacket 2 is part of an internal combustion engine E that is mounted in a vehicle V (e.g., a mobile body).

The water jacket 2 is a coolant passage inside the cylinder block and the cylinder head of the engine E. The water jacket 2 mainly surrounds the cylinders and the combustion chambers. The coolant is supplied to a water jacket inlet 2*a* by the water pump 3 and absorbs a portion of heat generated by the engine E as it passes by the cylinders and the combustion chambers.

The water jacket 2 and the radiator 4 are joined together by the coolant circulation passage 5 (coolant flow passage) such that coolant heated inside the engine E exits a water jacket outlet 2*b* and flows to a radiator inlet 4*a* via the coolant circulation passage 5. The radiator 4 is a heat exchanger serving to take heat from the heated coolant and discharge the heat to the atmosphere. The coolant is cooled by air passing through the radiator 4. When the vehicle V travels, a sufficient cooling wind can be obtained because a traveling wind hits a front surface of the radiator 4. Since the traveling wind is insufficient when the vehicle speed is slow or when the vehicle V is stopped with the engine idling, a cooling fan (not shown) is provided in rear of the radiator 4 to draw air across the radiator 4. Coolant cooled by the radiator 4 is returned from a radiator outlet 4*b* to the water jacket inlet 2*a* through the coolant circulation passage 5.

The first bypass passage 6 is provided such that it branches from the coolant circulation passage 5 upstream of the radiator inlet 4*a* and merges with the coolant circulation passage 5 upstream of the water pump 3. The thermostat 7 is provided in the coolant circulation passage 5 between the radiator outlet 4*b* and the point where the first bypass passage 6 merges with the coolant circulation passage 5. The thermostat 7 serves to keep the coolant temperature within a prescribed temperature range at which an optimum engine performance can be maintained by adjusting a flow rate of the coolant flowing through the radiator 4 in accordance with a coolant temperature. For example, the thermostat 7 is closed when the coolant temperature is below a prescribed temperature, such as when the engine is cold started. In this way, the coolant is circulated through the first bypass passage 6 without any of the coolant passing through the radiator 4 to promote heating of the coolant by the heat generated from the engine. As a result, the amount of time required for warming up the engine is shorter than if the coolant was allowed to circulate through the radiator 4. When the coolant temperature exceeds a prescribed temperature, the thermostat 7 opens coolant is supplied to the radiator 4 such that the temperature of the coolant is held within a prescribed temperature range.

A second bypass passage 8 is provided such that it branches from the coolant circulation passage 5 at the water jacket outlet 2*b* and merges with the coolant circulation passage 5 upstream of the water pump 3. A heater 9 is provided in an upstream portion of the second bypass passage 8. The heater 9 is a heat exchanger. Air passing through the heater 9 takes heat from coolant that has been heated by the engine. Air that has been heated by the heater 9 is fed to the inside of a vehicle cabin to heat the cabin.

An engine controller 11 is operatively connected to a coolant temperature sensor 12, an ambient air temperature sensor 13, a crank angle sensor 14 and a vehicle speed sensor 15. The engine controller 11 receives a signal indicating a coolant temperature Treal at the water jacket outlet 2*b* from the coolant temperature sensor 12. The engine controller 11 receives a signal indicating an ambient air temperature TAN from the ambient air temperature sensor 13. The engine controller 11 receives a signal indicating a crank angle from the crank angle sensor 14. The engine controller 11 receives a signal indicating a vehicle speed VSP (speed of vehicle) from the vehicle speed sensor 15. The engine controller 11 includes a thermostat diagnostic program that diagnoses whether or not the thermostat 7 is malfunctioning based on the signals from the sensors 12 to 15. For example, the engine controller 11 diagnoses whether or not the thermostat 7 is stuck in an open state based on these signals. If the engine controller 11 determines that the thermostat 7 is experiencing a stuck-open malfunction, then engine controller 11 issues a warning regarding the stuck-open malfunction of the thermostat 7 to a driver by an alarm device 21 (e.g., a warning lamp or a warning sound emitter) provided inside the vehicle cabin. The engine controller 11 constitutes a malfunction diagnosing device. The engine controller 11 together with the sensors 12 to 15 and the alarm device 21 constitute a thermostat diagnostic apparatus. With this thermostat diagnostic apparatus, as explained below, a highly accurate diagnosis can be accomplished early, even during a period before a prescribed amount of time has elapsed since operation of the vehicle V (mobile body) was started or during a period before the engine E has reached a prescribed warm-up state since operation of the vehicle V (mobile body) was started. In particular, it has been discovered that during a continuous period in which an increased heat exchange rate condition of the radiator 4 is satisfied, an accurate diagnosis can be accomplished without waiting until a prescribed amount of time has elapsed or a prescribed warm-up state has been reached.

The engine controller 11 preferably includes a microcomputer with a thermostat diagnostic program that determines if the thermostat 7 is malfunctioning as discussed below. The engine controller 11 also include other conventional components such as an input interface circuit, an output interface circuit, and storage devices such as a ROM (Read Only Memory) device and a RAM (Random Access Memory) device. The engine controller 11 typically controls other components of the engine E. However, it will be apparent to those skilled in the art from this disclosure that the engine controller 11 could be a dedicated controller if needed and/or desired. The precise structure and algorithms for the engine controller 11 can be any combination of hardware and software that will carry out the functions of determining if the thermostat 7 is malfunctioning.

Since the coolant temperature sensor 12 is provided at the water jacket outlet 2*b*, the detected temperature indicates a highest temperature of the coolant. However, the position of the coolant temperature sensor 12 is not limited to the water jacket outlet 2*b*. As will be explained later, in the present thermostat diagnostic apparatus, a first estimated coolant temperature Test1 and a second estimated coolant temperature Test2 are calculated by the engine controller 11. The coolant temperature Treal detected by the coolant temperature sensor 12 will be hereinafter called "real coolant temperature" to distinguish it from the estimated coolant temperatures Test1 and Test2 calculated by the engine controller 11.

Instead of the separately provided ambient air temperature sensor 13, it is also possible to use an existing air temperature sensor from another vehicle system of the vehicle for detecting the ambient air temperature. For example, a gasoline engine typically has an intake air temperature sensor that is provided in an air flow meter for measuring an intake air temperature. This intake air temperature sensor can be used instead of providing the ambient air temperature sensor 13.

In this embodiment, water is used as the coolant liquid (or cooling medium) for the engine cooling apparatus 1, but the engine cooling apparatus 1 is not limited to using water. It is also acceptable for the coolant to be antifreeze or any other suitable cooling medium.

When the engine E is cold started, the amount of fuel supplied to the engine E is increased such that warming up of the engine E is completed earlier. If the thermostat 7 is malfunctioning (stuck-open failure) wherein thermostat 7 remains open and will not close, then the warming of the engine E will not be promoted during cold starting and an increased amount of fuel will continue to be supplied, degrading the fuel efficiency of the vehicle. Therefore, the existing technology diagnose if the thermostat 7 is stuck in the opened state at a point after a prescribed amount of time has elapsed since the engine E was started or after the engine E has reached a prescribed warm-up state. However, with the existing technology, completion of the diagnosis is sometimes late because it is necessary to wait until a prescribed amount of time has elapsed since the engine E was started or until the engine E has reached a prescribed warm-up state. It has been observed that when an increased heat exchange rate condition of the radiator 4 exists, a stuck-open malfunction diagnosis in the thermostat 7 can be accomplished with improved accuracy.

During a continuous period in which an increased heat exchange rate condition of the radiator 4 is satisfied, the thermostat diagnostic apparatus conducts the diagnoses of the thermostat 7 for a stuck-open malfunction when the real coolant temperature (real cooling medium temperature) or an estimated coolant temperature (estimated cooling medium temperature) exceeds a prescribed reference temperature. In this way, a highly accurate diagnosis can be executed early without waiting for a prescribed amount of time to elapse since the engine E was started or waiting until the engine E reaches a prescribed warm-up state.

With the present thermostat diagnostic apparatus, the diagnosis of whether or not the thermostat 7 is incurring a stuck-open malfunction is executed when an increased heat exchange rate condition of the radiator 4 is satisfied for a continuous period of time (i.e., when a condition exists that enables a diagnosis to be accomplished with improved accuracy) before the engine E reaches a prescribed warm-up state after the engine E is cold started. As a result, an effect of increasing the frequency of diagnosis can be obtained. More specifically, the vehicle is operated in a prescribed mode and a comparison is made between a measured real coolant temperature occurring when the thermostat 7 remains open (i.e., when a situation is simulated in which the thermostat 7 is incurring a stuck-open malfunction) and a measured real coolant temperature occurring when the thermostat 7 remains closed (i.e., when the thermostat 7 is normal and not incurring a stuck-open malfunction). A larger difference exists between the two real coolant temperatures if the vehicle V is traveling in a region where the vehicle speed VSP is continuously higher than a prescribed vehicle speed (a vehicle speed criterion explained later) than if the vehicle speed is below the prescribed vehicle speed. As a result, it can be concluded that the reason for the large difference between the real coolant temperature observed when the thermostat 7 is incurring a stuck-open malfunction (a "stuck-open thermostat") and the real coolant temperature observed when the thermostat 7 is normal and not incurring a stuck-open malfunction (a "normal thermostat") is that a period of traveling continuously at a high vehicle speed corresponds to a period in which an heat exchange rate of the radiator 4 is continuously larger (i.e., a period in which the radiator 4 is actively discharging heat due to the high vehicle speed).

More specifically, satisfying the aforementioned condition of an increased heat exchange rate of the radiator 4 means that the vehicle speed VSP is relatively high such that a strong traveling wind (air) passes through the radiator 4 such that the amount of heat discharged from the radiator 4 is relatively large. Conversely, not satisfying the condition increased heat exchange rate of the radiator 4 means that the vehicle speed VSP is relatively low such that only a weak traveling wind air) passes through the radiator 4 such that the amount of heat discharged from the radiator 4 is relatively small.

It is believed that usually the amount of heat generated by the engine E is relatively large when the vehicle speed VSP is relatively high and the amount of heat generated by the engine E is relatively small when the vehicle speed is relatively low. Thus, if the thermostat 7 does not have a stuck-open malfunction and the thermostat is fully closed during a period in which an increased heat exchange rate condition of the radiator 4 is satisfied continuously due to the vehicle speed VSP being relatively high, then it is reasonable to expect that the real coolant temperature will rise (change) rapidly due to the relatively large amount of heat generated from the engine E. Conversely, if the thermostat 7 is stuck open during a period in which an increased heat exchange rate condition of the radiator 4 is satisfied continuously, then it is reasonable to expect that the real coolant temperature will not rise (change) readily.

Meanwhile, if the thermostat 7 is not stuck open and is fully closed during a period in which an increased heat exchange rate condition of the radiator 4 is not satisfied, then it is reasonable to expect that the real coolant temperature will increase (change) only gradually because the amount of heat generated from the engine E is relatively small. Conversely, if the thermostat 7 is stuck open during a period when an increased heat exchange rate condition of the radiator 4 is not satisfied, then it is reasonable to expect the real coolant temperature to rise (change) even more gradually than if the thermostat 7 were not stuck open and but fully closed.

Thus, if one compares a period during which an increased heat exchange rate condition of the radiator 4 is satisfied continuously to a period in which an increased heat exchange rate condition of the radiator 4 is not satisfied, then one will find that the difference between a real coolant temperature occurring when the thermostat 7 is incurring a stuck-open malfunction and a real coolant temperature occurring when the thermostat 7 is normal and not incurring a stuck-open malfunction is larger during a period in which an increased heat exchange rate condition of the radiator 4 is satisfied continuously than during a period when the same condition is not satisfied. As a result, a diagnosis of whether or not the thermostat 7 has malfunctioned (stuck-open) can be accomplished earlier and more accurately during a period in which an increased heat exchange rate condition of the radiator 4 is satisfied continuously.

The embodiment will now be explained further with reference to the FIGS. 7, 8, 9, and 10. FIGS. 7, 8, 9, and 10 illustrate models of how the vehicle speed VSP and the real coolant temperature Treal change when the engine E is started at a time t1. The vehicle V remains in a stopped state until a time t2. At the time t2, the vehicle starts being driven and the vehicle speed VSP increases. At a time t3, the vehicle speed VSP exceeds a vehicle speed criterion SL1 (prescribed speed). The vehicle speed VSP falls below the vehicle speed criterion SL1 at a time t6 and the vehicle V stops at a time t7. The vehicle speed criterion SL1 is used to determine a boundary between where the increased heat exchange rate condition of the radiator 4 is satisfied and where the same condition is not satisfied. Thus, the period from t3 to t6 is a period in which the increased heat exchange rate condition of the radiator 4 is satisfied continuously. For simplicity, the ambient air temperature TAN is assumed to be a reference ambient air temperature TAN0 (a fixed value) in FIGS. 7, 8, 9, and 10.

If a period in which the increased heat exchange rate condition of the radiator 4 is satisfied continuously occurs immediately after the engine E is started, then a real coolant temperature Treal (indicated with a solid-line curve) occurring during the period in which the increased heat exchange rate condition of the radiator 4 is satisfied continuously will increase faster than a real coolant temperature (not shown) occurring during a period in which the increased heat exchange rate condition of the radiator 4 is not satisfied. Consequently, the real coolant temperature Treal reaches a prescribed temperature Tc at a timing t4 and a condition for executing a diagnosis is satisfied. With a conventional technology, the condition for executing a diagnosis would occur later than the time t7.

Calculation of an estimated coolant temperature is started from the time t4 when the diagnosis condition is satisfied and the thermostat 7 is diagnosed for a stuck-open malfunction when either the real coolant temperature or the estimated coolant temperature exceeds a prescribed reference value.

A "normal thermostat low estimated temperature" and a "stuck-open thermostat high estimated temperature" are used as estimated coolant temperatures. Hereinafter, a normal thermostat low estimated temperature used as an estimated coolant temperature is called a first estimated coolant temperature Test1 and a stuck-open thermostat high estimated temperature used as an estimated coolant temperature is called a second estimated coolant temperature Test2 in order to distinguish the two.

The normal thermostat low estimated temperature is a temperature that the real coolant temperature Treal is expected to exceed when the thermostat is normal. When the real coolant temperature is plotted with respect to time for a normal thermostat, the real coolant temperatures are distributed within a certain range of variation due to differences between individual engines. The first estimated coolant temperature Test1 serving as the normal thermostat low estimated temperature is calculated based on an engine operating condition such that the normal thermostat low estimated temperature stays below all of the real coolant temperatures of the distribution.

After calculating the first estimated coolant temperature Test1 as just described, a diagnosis of whether or not the thermostat 7 has malfunctioned (stuck-open) can be accomplished by setting a determination permission temperature Td (prescribed reference value) that is higher than the prescribed temperature Tc by a prescribed value and detecting which of the first estimated coolant temperature Test1 and the real coolant temperature Treal first exceeds the determination permission temperature Td. The reason this works is that after the time t4, the real coolant temperature Treal increases faster than the first estimated coolant temperature Test1 if the thermostat 7 is normal and more slowly than the first estimated coolant temperature Test1 if the thermostat 7 has a stuck-open malfunction. Thus, it can be diagnosed that the thermostat 7 does not have a stuck-open malfunction (is normal) if the real coolant temperature Treal exceeds the determination permission temperature Td before the first estimated coolant temperature Test1 does and that the thermostat 7 has a stuck-open malfunction if the first estimated coolant temperature Test1 exceeds the determination permission temperature Td before the real coolant temperature Treal does.

Figure 7:
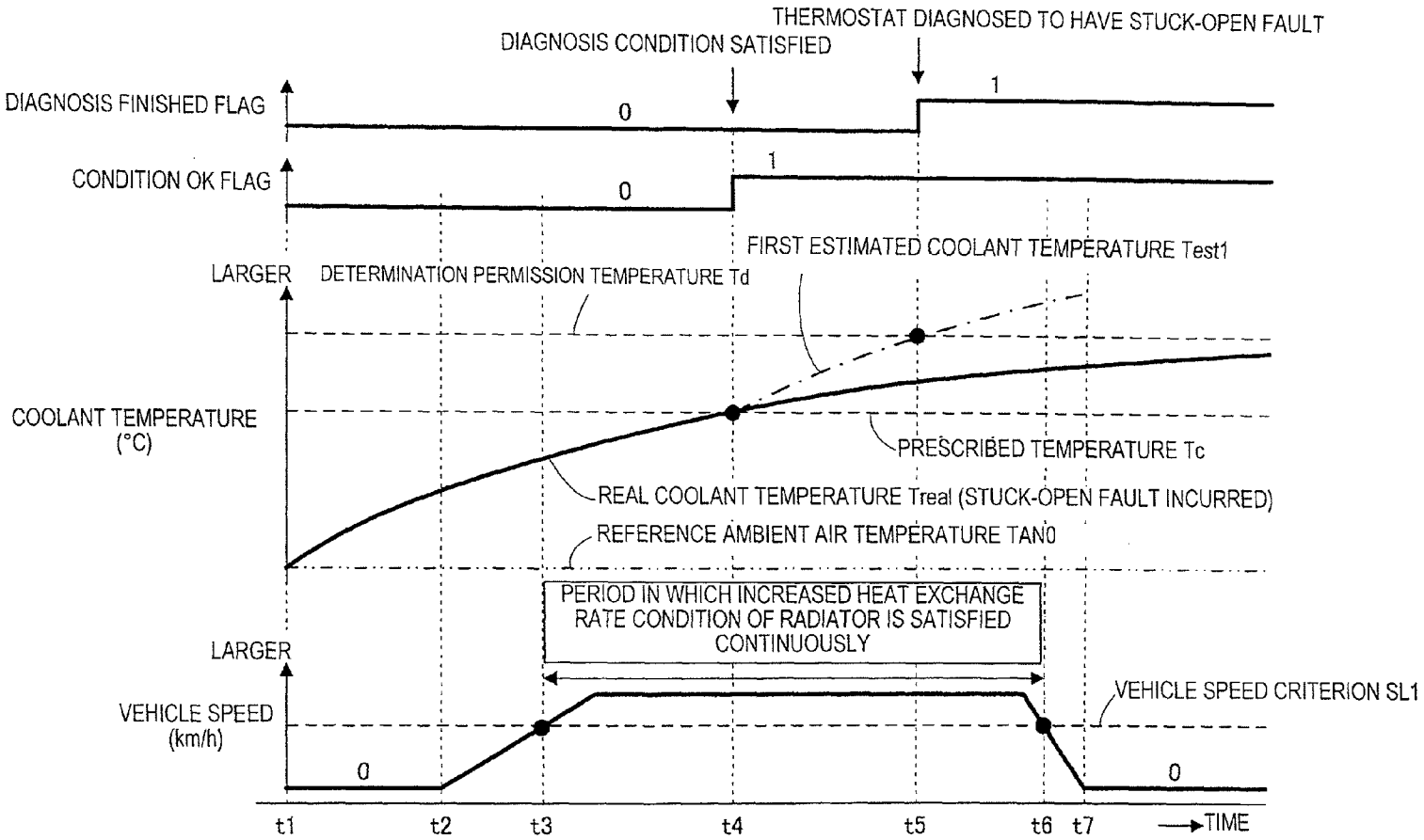
FIG. 7 is a time chart for explaining a method of diagnosing a thermostat based directly on a coolant temperature where a stuck-open fault has been diagnosed.
Figure 8:
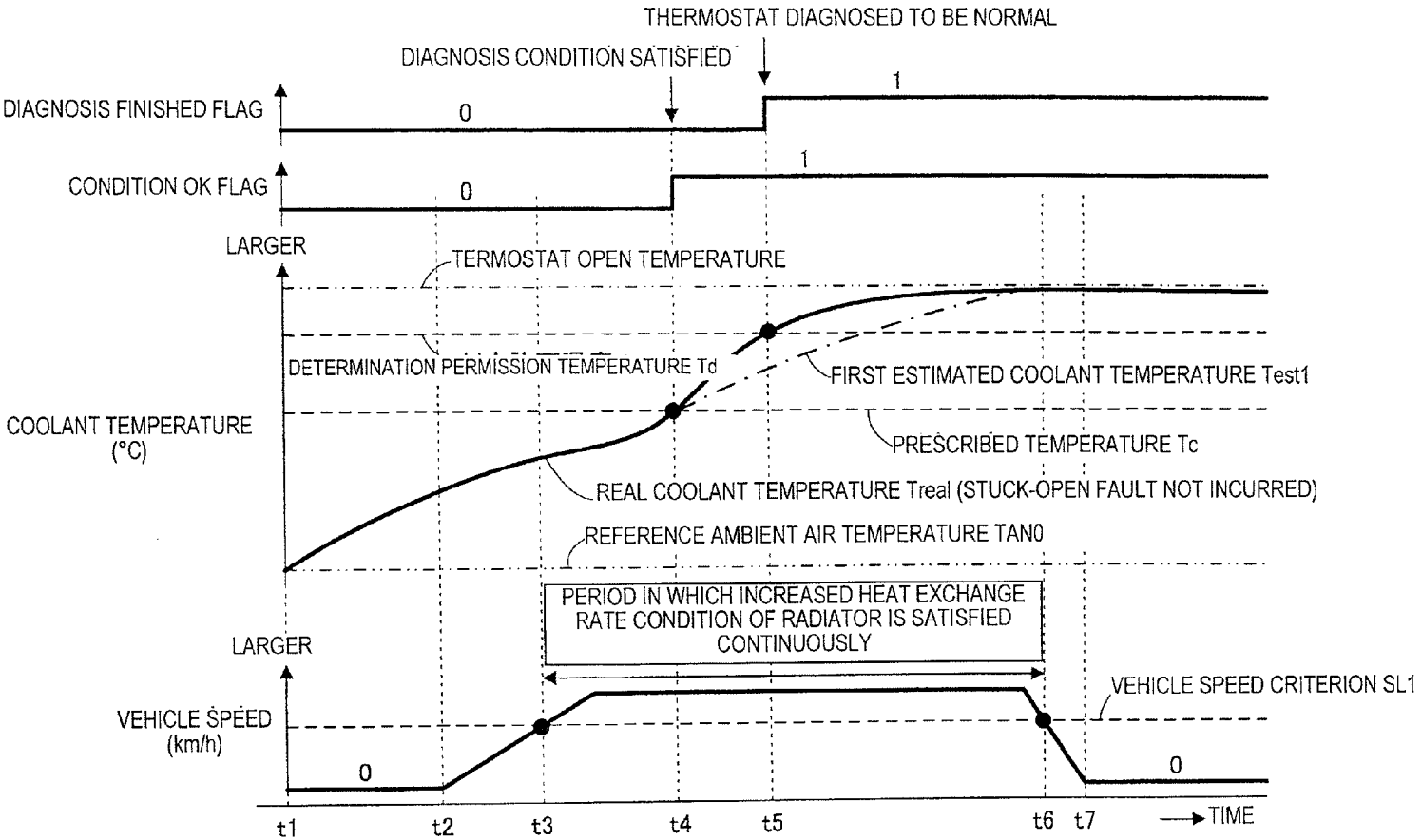
FIG. 8 is a time chart for explaining a method of diagnosing a thermostat based directly on a coolant temperature where a stuck-open fault has not been diagnosed.

More specifically, FIG. 7 shows how the real coolant temperature Treal changes when the thermostat 7 has a stuck-open malfunction and FIG. 8 shows how the real coolant temperature Treal changes when the thermostat 7 is normal. In FIG. 7, the first estimated coolant temperature Test1 exceeds the determination permission temperature Td at a time t5 occurring before the real coolant temperature Treal exceeds the determination permission temperature Td and, thus, the thermostat 7 is diagnosed as having a stuck-open malfunction at the time t5. Meanwhile, in FIG. 8, the real coolant temperature Treal exceeds the determination permission temperature Td at a time t5 occurring before the first estimated coolant temperature Test1 exceeds the determination permission temperature Td and, thus, the thermostat 7 is diagnosed as not having a stuck-open malfunction, i.e., as being normal, at the time t5.

The stuck-open thermostat high estimated temperature is a temperature that the real coolant temperature Treal is expected to be below when the thermostat is has a stuck-open malfunction. When the real coolant temperature is plotted with respect to time for a stuck-open thermostat, the real coolant temperatures are distributed within a certain range of variation due to differences between individual engines. The second estimated coolant temperature Test2 serving as the stuck-open thermostat high estimated temperature is calculated based on an engine operating condition such that the stuck-open thermostat high estimated temperature stays above all of the real coolant temperatures of the distribution.

After calculating the second estimated coolant temperature Test2 as just described, a diagnosis of whether or not the thermostat 7 has malfunctioned (stuck-open) can be accomplished by setting a determination permission temperature Td (prescribed reference value) that is higher than the prescribed temperature Tc by a prescribed value and detecting which of the second estimated coolant temperature Test2 and the real coolant temperature Treal first exceeds the determination permission temperature Td. The reason this works is that after the time t4, the real coolant temperature Treal increases faster than the second estimated coolant temperature Test2 if the thermostat 7 is normal and more slowly than the second estimated coolant temperature Test2 if the thermostat 7 has a stuck-open malfunction. Thus, it can be diagnosed that the thermostat 7 does not have a stuck-open malfunction (operation is normal) if the real coolant temperature Treal exceeds the determination permission temperature Td before the second estimated coolant temperature Test2 does and that the thermostat 7 has a stuck-open malfunction if the second estimated coolant temperature Test2 exceeds the determination permission temperature Td before the real coolant temperature Treal does.

Figure 9:
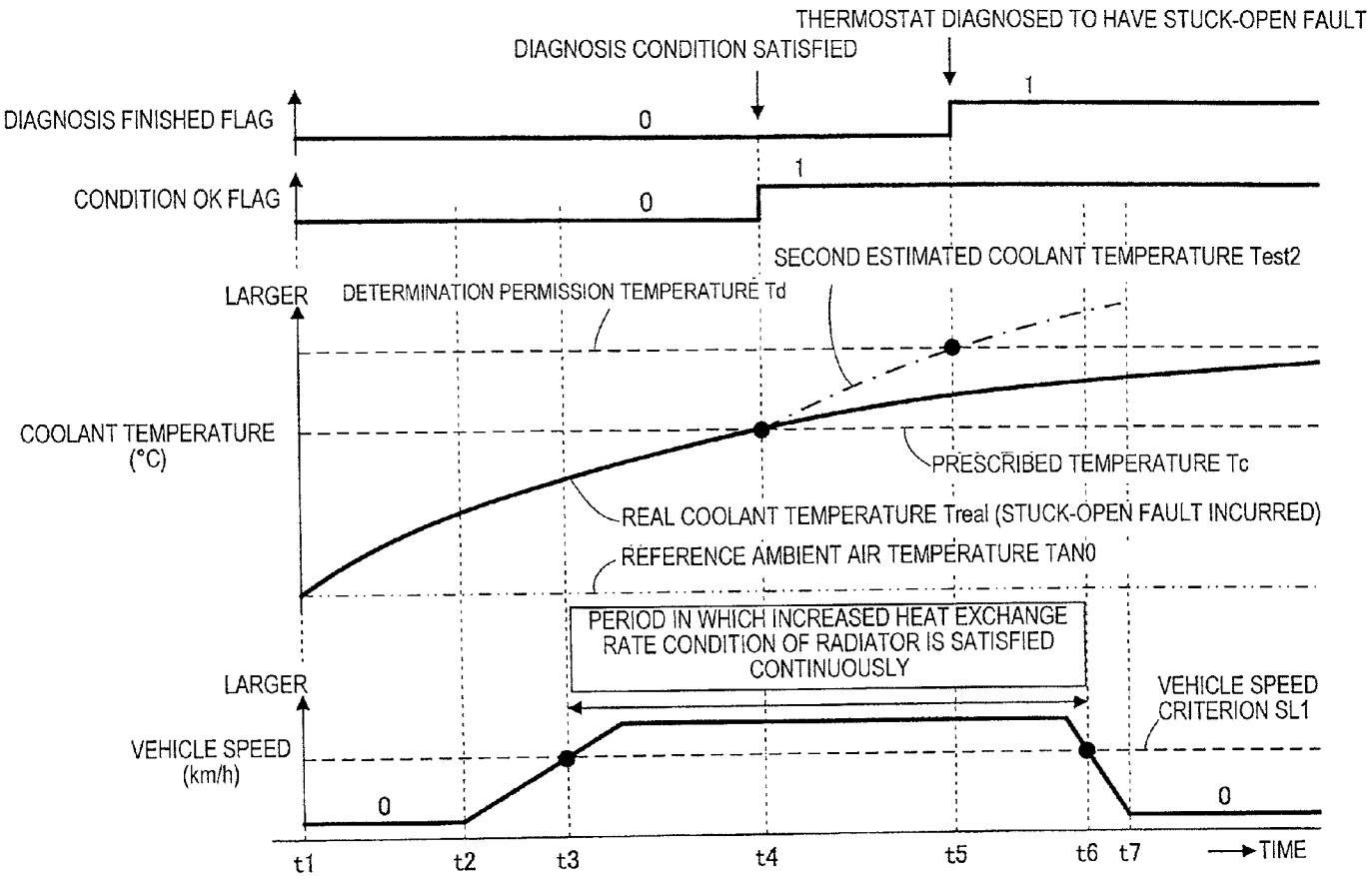
FIG. 9 is a time chart for explaining a method of diagnosing a thermostat based directly on a coolant temperature where a stuck-open fault has been diagnosed.
Figure 10:
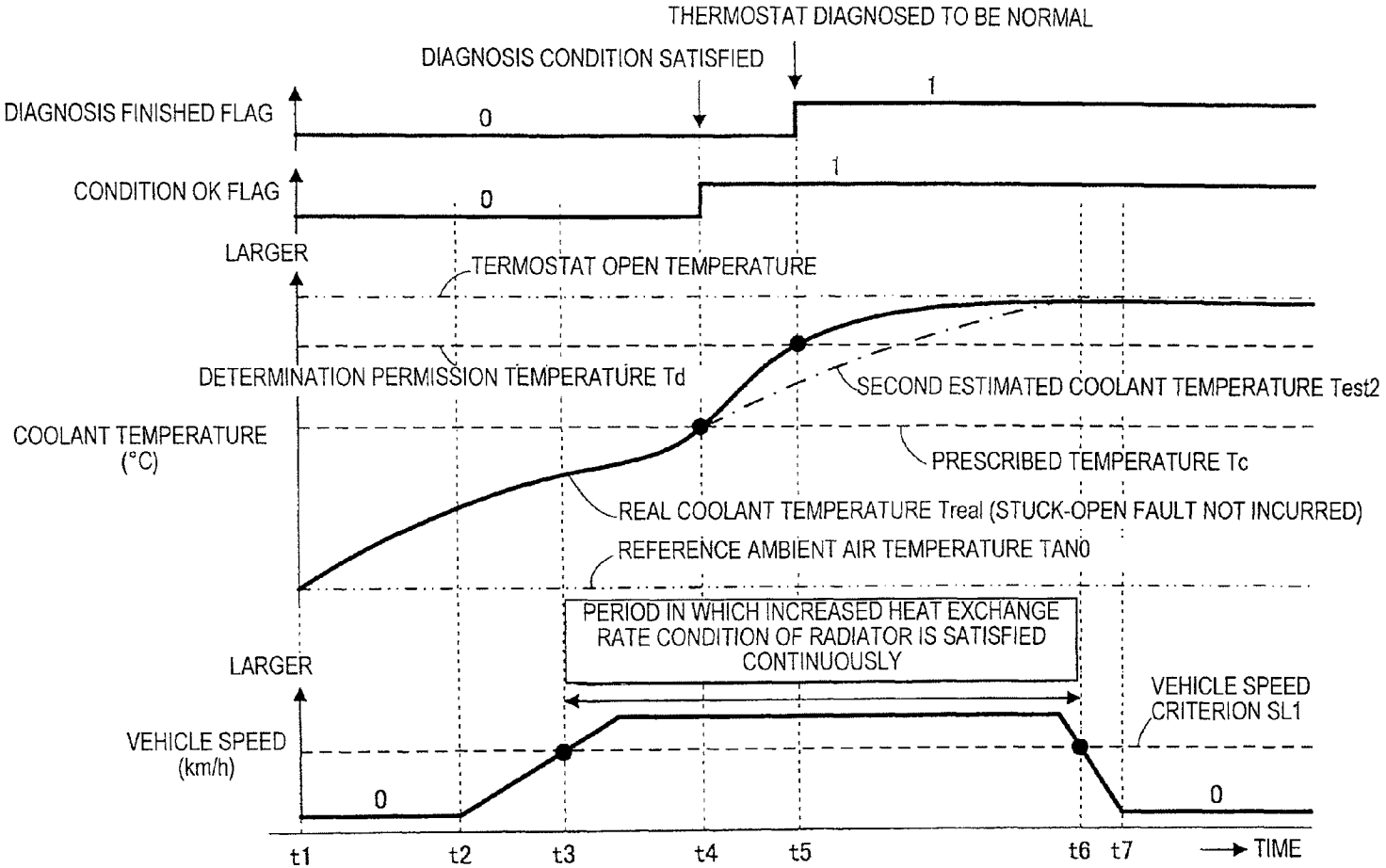
FIG. 10 is a time chart for explaining a method of diagnosing a thermostat based directly on a coolant temperature where a stuck-open fault has not been diagnosed.

More specifically, FIG. 9 shows how the real coolant temperature Treal changes when the thermostat 7 has a stuck-open malfunction and FIG. 10 shows how the real coolant temperature Treal changes when the thermostat 7 is normal. In FIG. 9, the second estimated coolant temperature Test2 exceeds the determination permission temperature Td at a time t5 occurring before the real coolant temperature Treal exceeds the determination permission temperature Td and, thus, the thermostat 7 is diagnosed as having a stuck-open malfunction at the time t5. Meanwhile, in FIG. 10, the real coolant temperature Treal exceeds the determination permission temperature Td at a time t5 occurring before the second estimated coolant temperature Test2 exceeds the determination permission temperature Td and, thus, the thermostat 7 is diagnosed as not having a stuck-open malfunction, i.e., as being normal, at the time t5. In this way, the thermostat diagnostic apparatus can be provided in which a stuck-open thermostat high estimated temperature that a real cooling medium temperature is expected to be below when a thermostat has incurred a stuck-open malfunction is calculated as an estimated cooling medium temperature and the thermostat is diagnosed to have incurred a stuck-open malfunction when the real cooling medium temperature falls below the estimated cooling medium temperature.

Thus, when the first estimated coolant temperature Test1 is used as the estimated coolant temperature, the statement "the thermostat 7 is diagnosed for a stuck-open malfunction when either the real coolant temperature or the estimated coolant temperature exceeds a prescribed reference value" means that the thermostat 7 is diagnosed to have incurred an stuck-open malfunction if the first estimated coolant temperature Test1 exceeds the prescribed reference value (determination permission temperature Td) before the real coolant temperature Treal does and the thermostat 7 is diagnosed not to have incurred a stuck-open malfunction, i.e., to be normal, if the real coolant temperature Treal exceeds the prescribed reference value (determination permission temperature Td) before the first estimated coolant temperature Test1 does.

Meanwhile, when the second estimated coolant temperature Test2 is used as the estimated coolant temperature, the statement "the thermostat 7 is diagnosed for a stuck-open malfunction when either the real coolant temperature or the estimated coolant temperature exceeds a prescribed reference value" means that the thermostat 7 is diagnosed to have incurred an stuck-open malfunction if the second estimated coolant temperature Test2 exceeds the prescribed reference value (determination permission temperature Td) before the real coolant temperature Treal does and the thermostat 7 is diagnosed not to have incurred a stuck-open malfunction, i.e., to be normal, if the real coolant temperature Treal exceeds the prescribed reference value (determination permission temperature Td) before the second estimated coolant temperature Test2 does.

In FIGS. 7, 8, 9, and 10, the ambient air temperature TAN is assumed to be a reference ambient air temperature TAN0 (a fixed value) for simplicity. However, in actual practice, the ambient air temperature TAN changes with the season and with the time of day. A change in the ambient air temperature TAN affects the determination of whether or not the diagnosis condition is satisfied and affects the accuracy of a diagnosis of whether or not the thermostat 7 has incurred a stuck-open malfunction. In order to eliminate the effect of the ambient air temperature TAN, a temperature difference corresponding to a value (Tc−TAN) obtained by subtracting the ambient air temperature TAN from the prescribed temperature Tc can be used instead of the prescribed temperature Tc to serve as a temperature difference criterion SL2 (prescribed temperature difference).

Figure 2A:
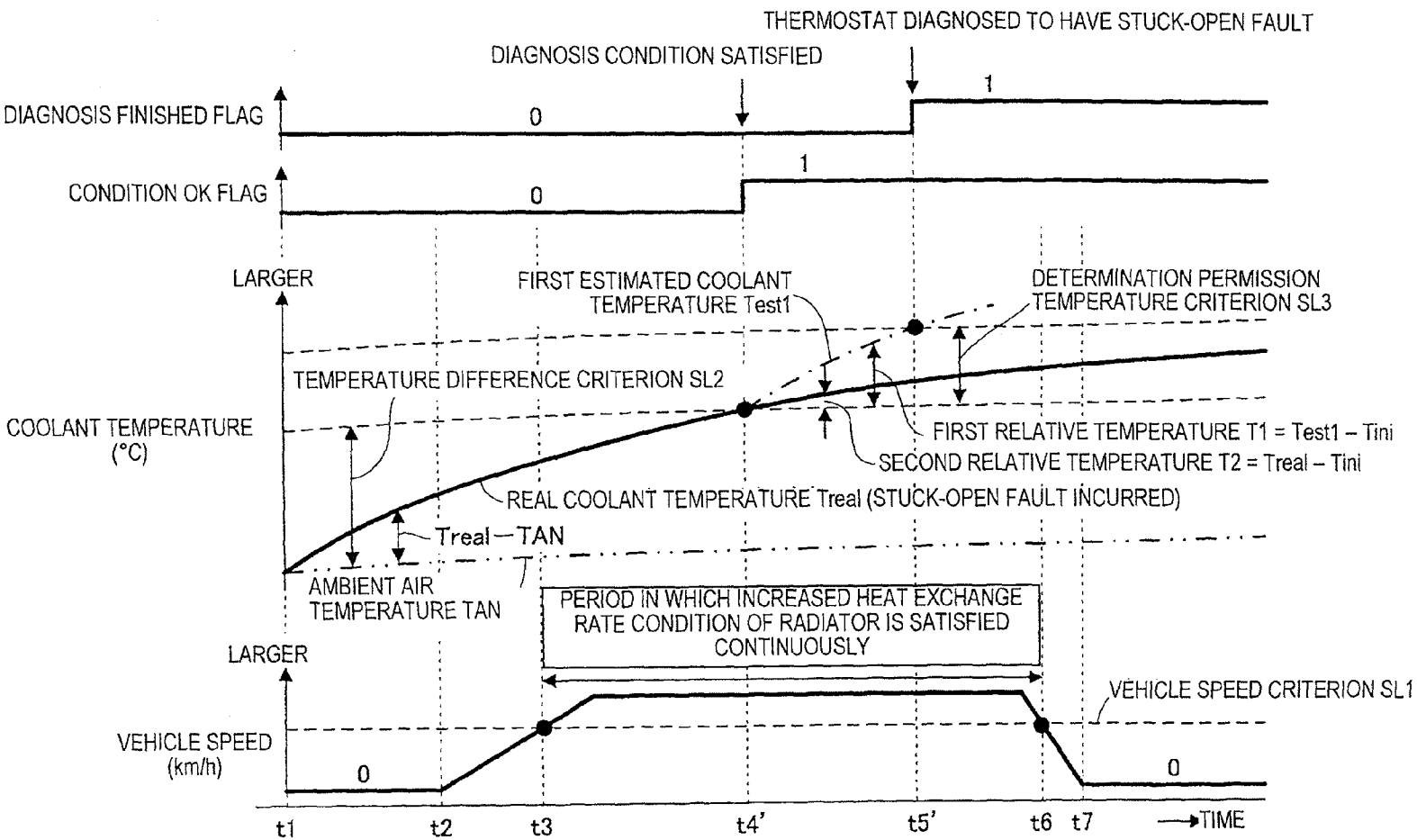
FIG. 2A is a timing chart for explaining a method of diagnosing a thermostat based on a temperature difference between a coolant temperature and an ambient air temperature where a stuck-open fault has been diagnosed.
Figure 2B:
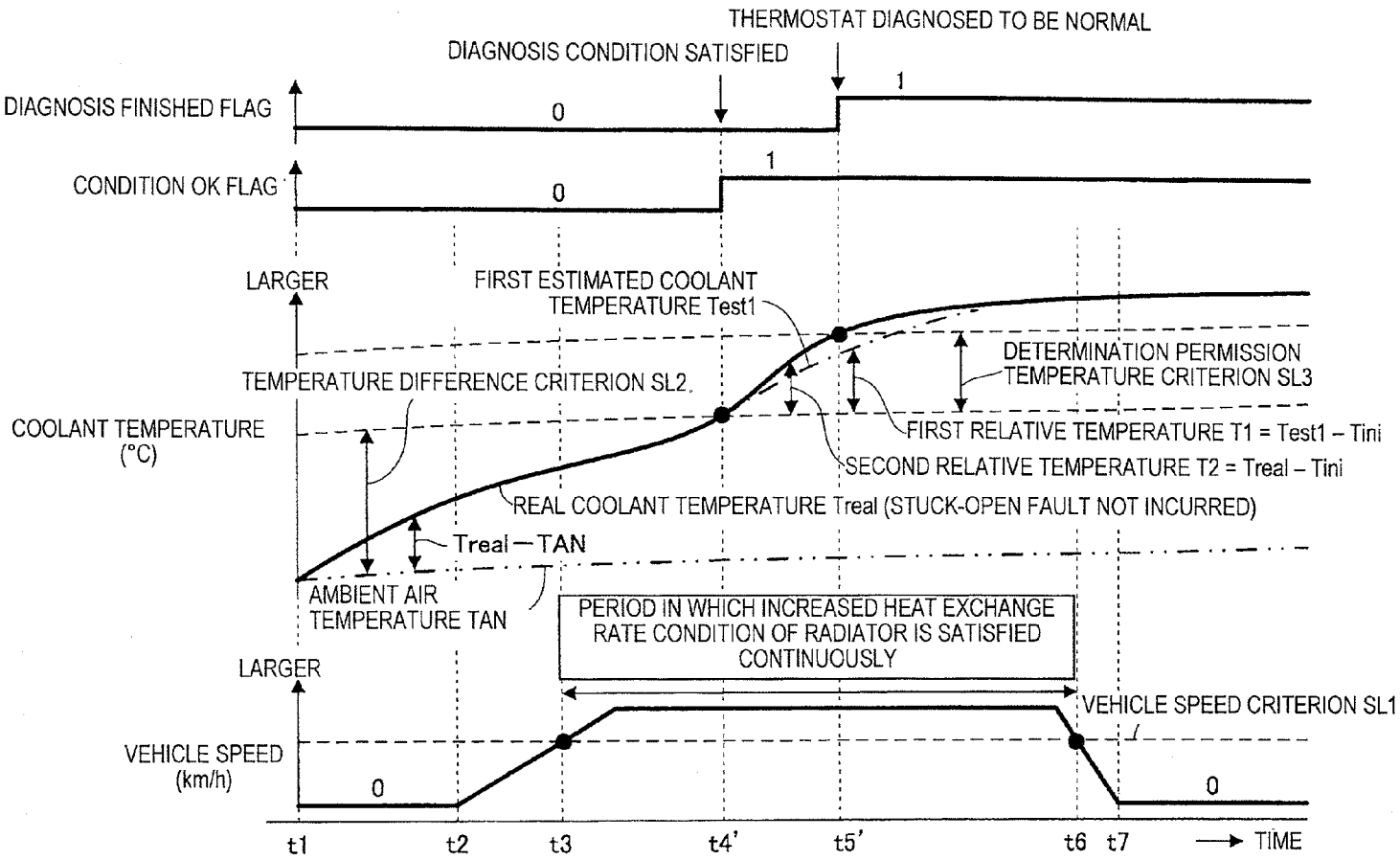
FIG. 2B is a time chart for explaining a method of diagnosing a thermostat based on a temperature difference between a coolant temperature and an ambient air temperature where a stuck-open fault has not been diagnosed.
Figure 2C:
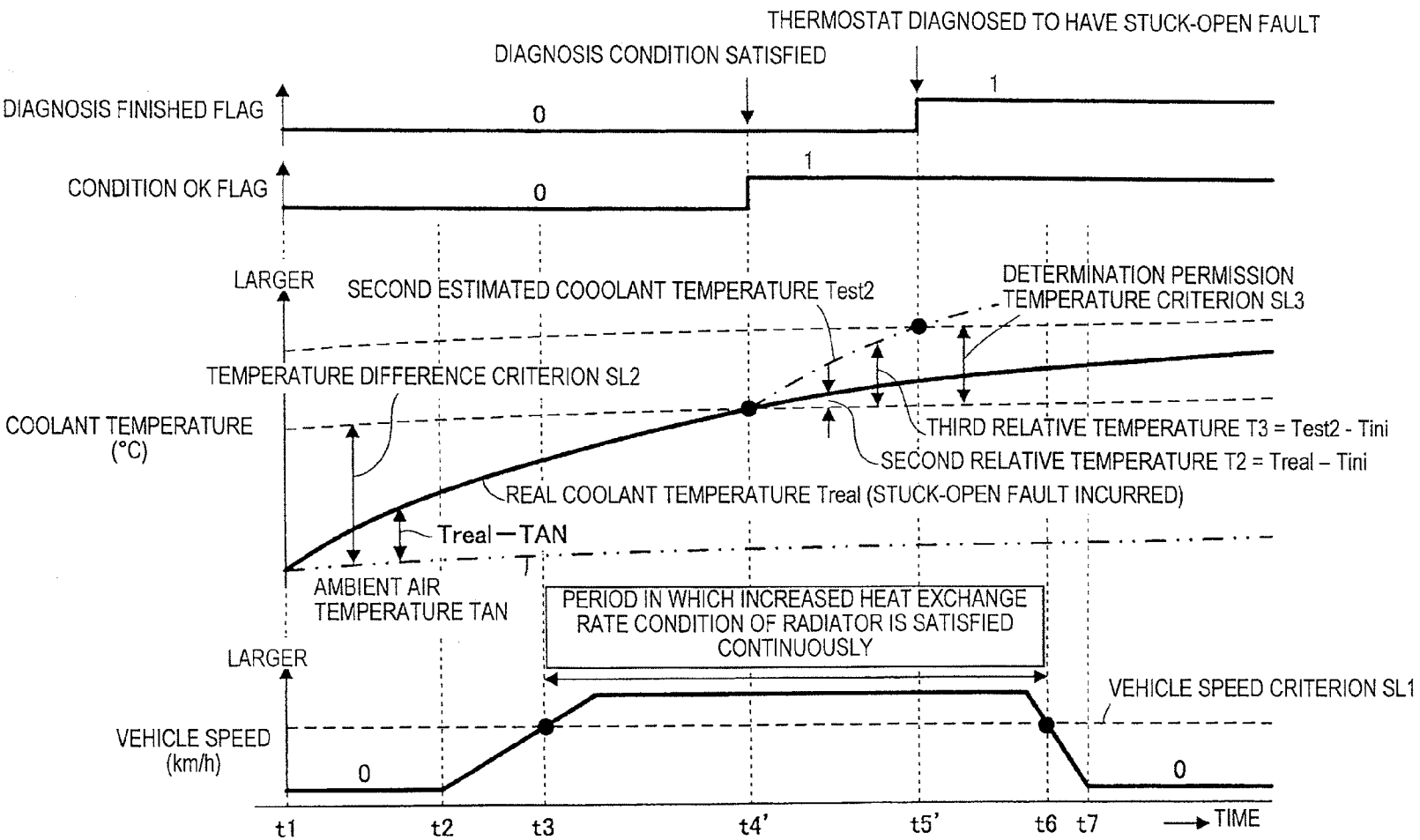
FIG. 2C is a time chart for explaining a method of diagnosing a thermostat based on a temperature difference between a coolant temperature and an ambient air temperature where a stuck-open fault has been diagnosed.
Figure 2D:
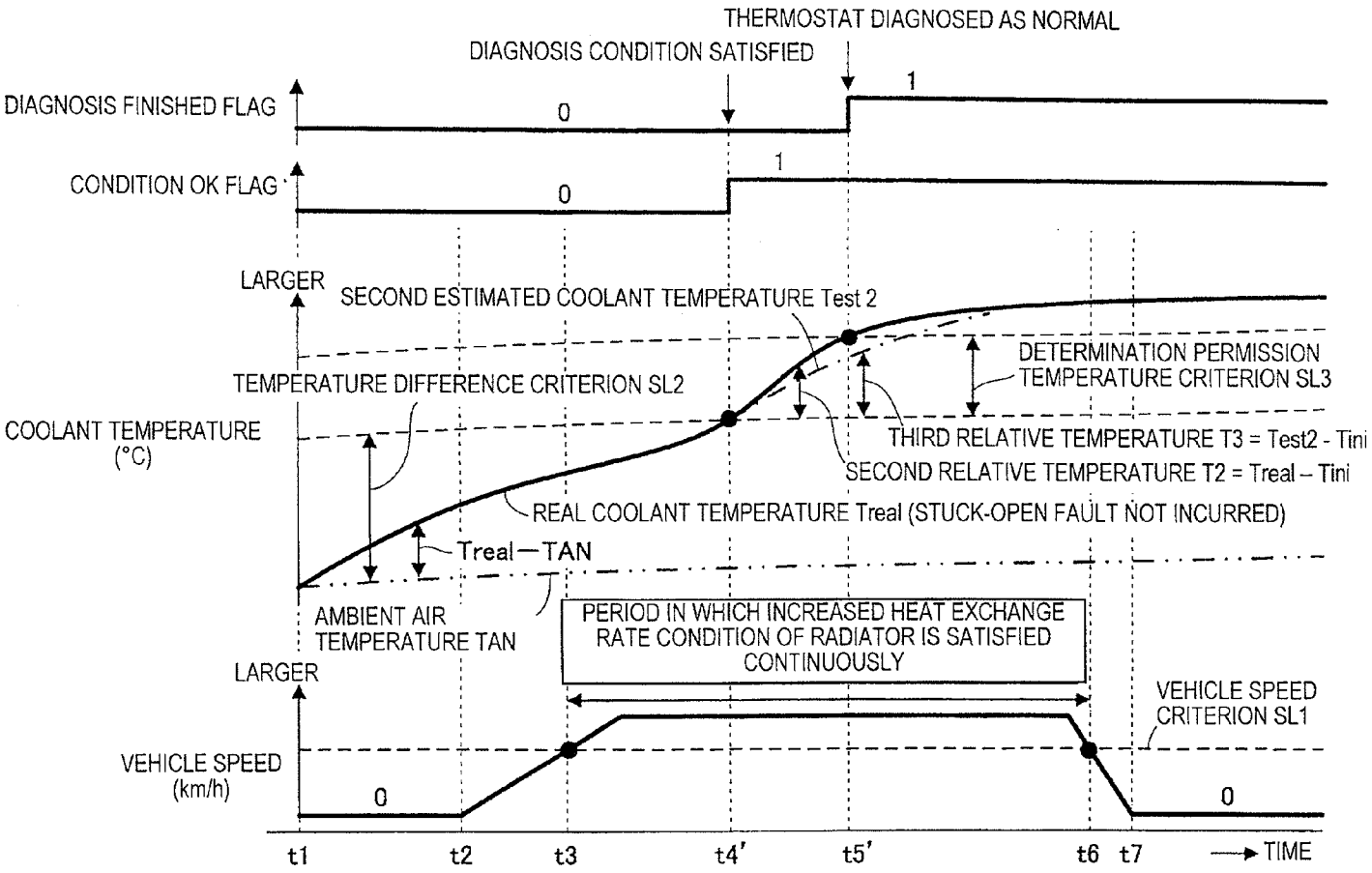
FIG. 2D is a time chart for explaining a method of diagnosing a thermostat based on a temperature difference between a coolant temperature and an ambient air temperature where a stuck-open fault has not been diagnosed.
Figure 2E:
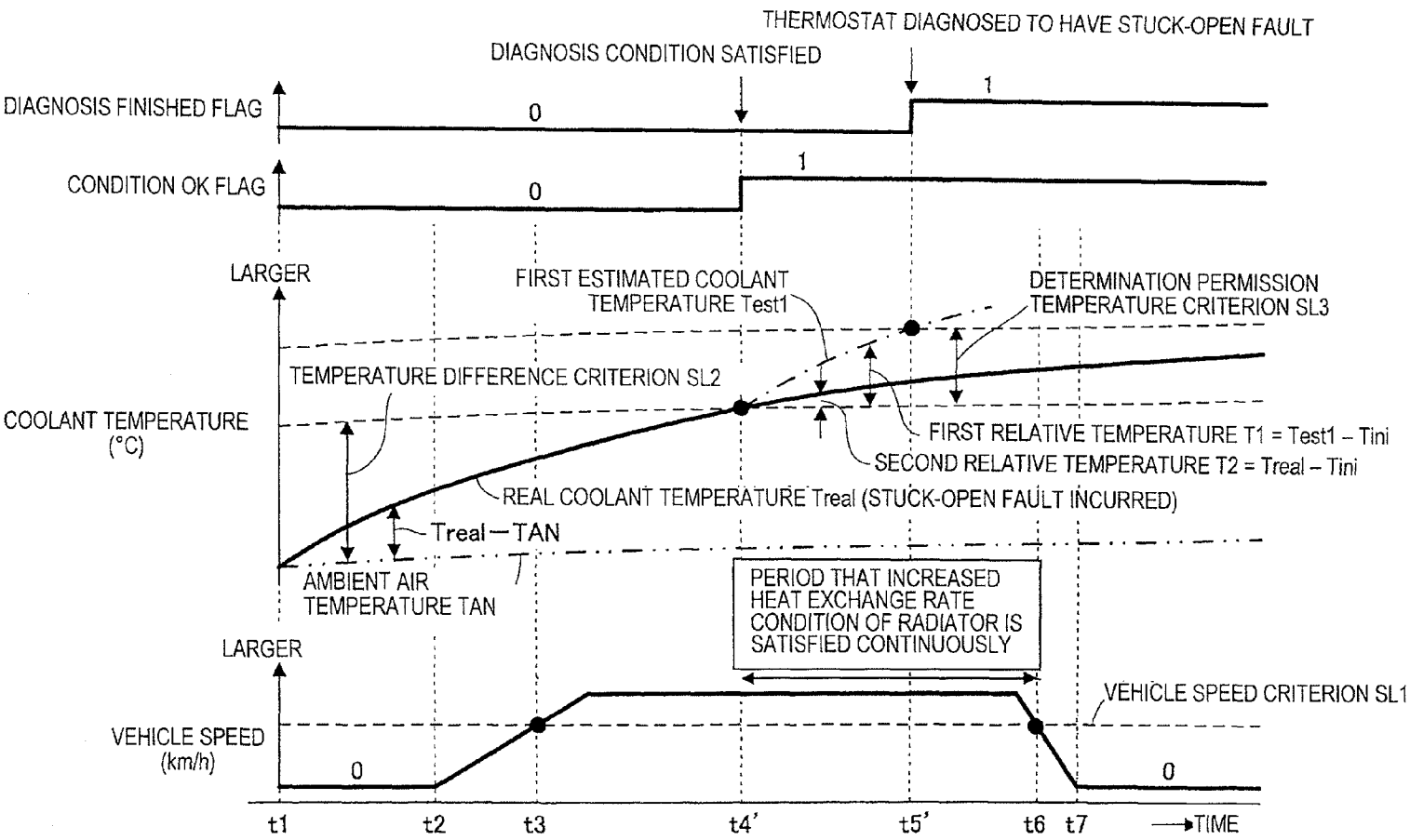
FIG. 2E is a timing chart, similar to FIG. 2A, for explaining an alternate method of diagnosing a thermostat based on a temperature difference between a coolant temperature and an ambient air temperature where a stuck-open fault has been diagnosed.
Figure 2F:
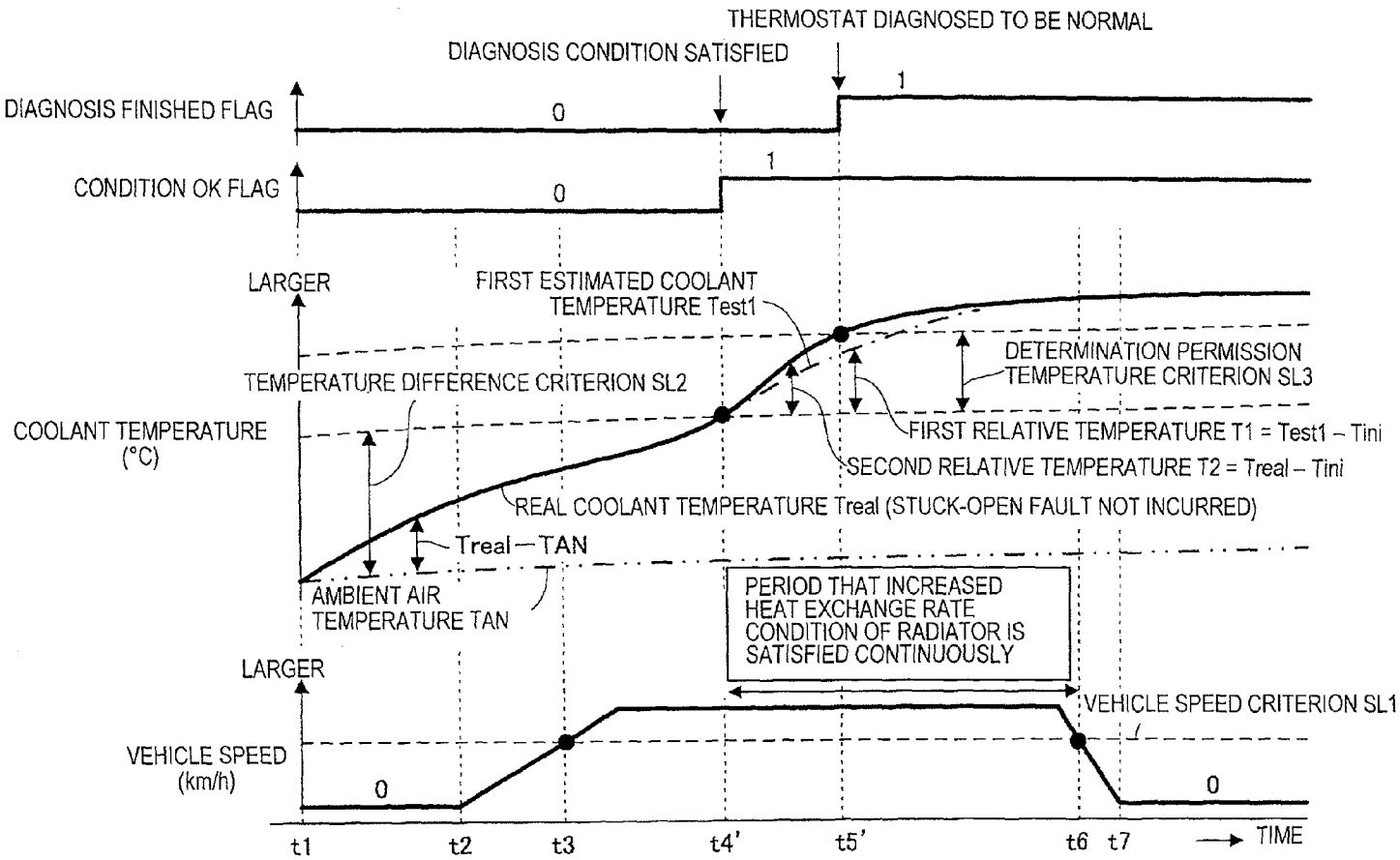
FIG. 2F is a time chart, similar to FIG. 2B, for explaining an alternate method of diagnosing a thermostat based on a temperature difference between a coolant temperature and an ambient air temperature where a stuck-open fault has not been diagnosed.
Figure 2G:
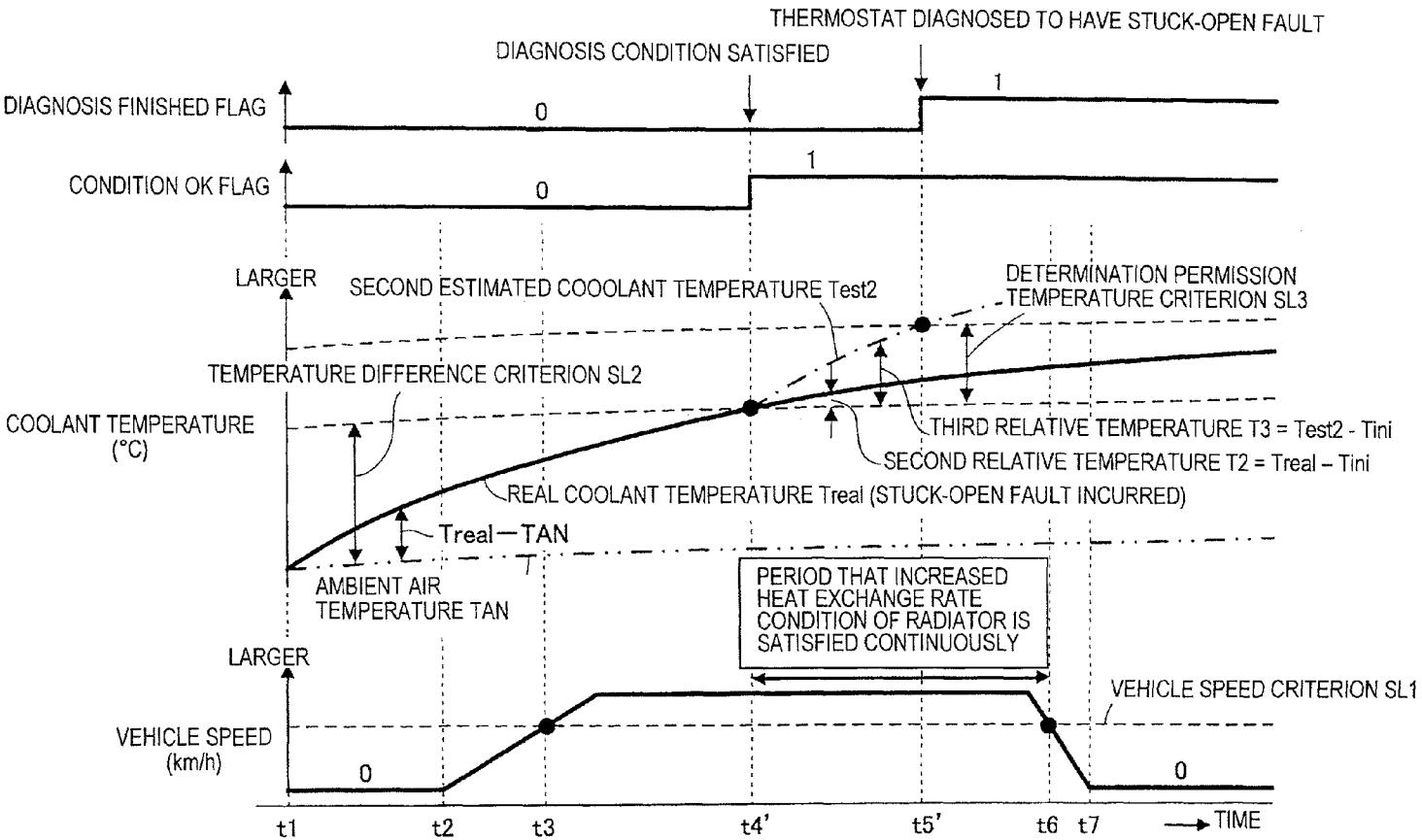
FIG. 2G is a time chart, similar to FIG. 2C, for explaining an alternate method of diagnosing a thermostat based on a temperature difference between a coolant temperature and an ambient air temperature where a stuck-open fault has been diagnosed.
Figure 2H:
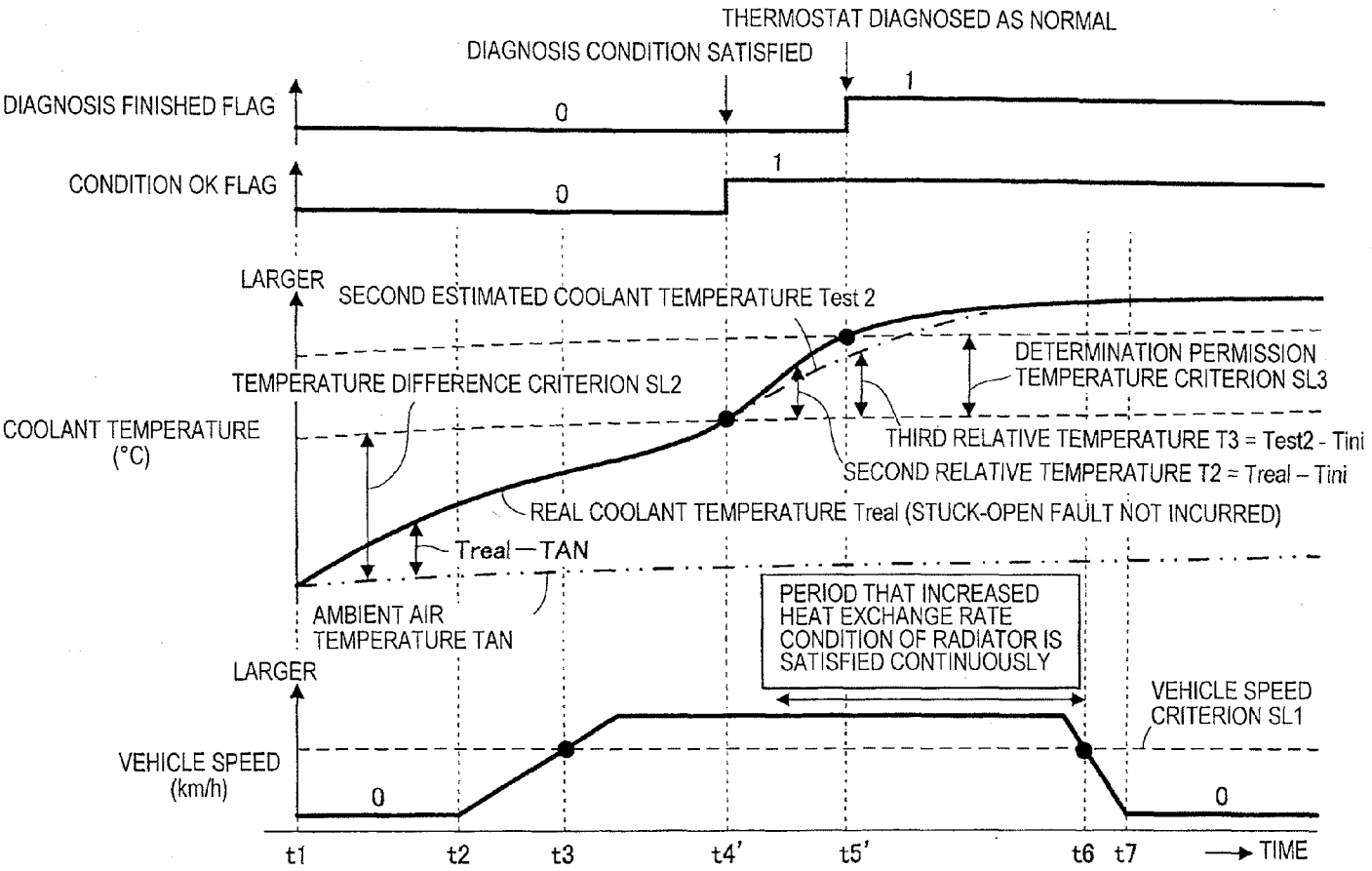
FIG. 2H is a time chart, similar to FIG. 2D, for explaining an alternate method of diagnosing a thermostat based on a temperature difference between a coolant temperature and an ambient air temperature where a stuck-open fault has not been diagnosed.

A method of diagnosing the thermostat 7 using a difference between a coolant temperature and an ambient air temperature TAN will now be explained with reference to FIGS. 2A, 2B, 2C, and 2D. Similarly to the way FIGS. 7 and 8 illustrate a case in which a first estimated coolant temperature Test1 is used and FIGS. 9 and 10 illustrate a case in which a second estimated coolant temperature Test2 is used, FIGS. 2A and 2B illustrate a case in which a first estimated coolant temperature Test1 is used and FIGS. 2C and 2D illustrate a case in which a second estimated coolant temperature Test2 is used. The manner in which the vehicle speed VSP changes is the same in FIGS. 2A, 2B, 2C, and 2D as it is in FIGS. 7, 8, 9, and 10. In FIGS. 2A, 2B, 2C, and 2D, the ambient air temperature TAN gradually increases after a start time t1 and a temperature obtained by adding the temperature difference criterion SL2 (fixed value) to the ambient air temperature TAN changes (increases) in accordance with the ambient air temperature TAN. It is determined that a diagnosis condition is satisfied at a time t4' when a temperature difference (Treal−TAN) obtained by subtracting the ambient air temperature TAN from the real coolant temperature Treal becomes equal to the temperature difference criterion SL2.

In FIGS. 2A, 2B, 2C and 2D, it is determined that the increased heat exchange rate condition of the radiator 4 is satisfied when at least the vehicle speed VSP is higher than the vehicle speed criterion SL1 (prescribed speed). However, as seen in FIGS. 2E, 2F, 2G and 2H, it is determined that the increased heat exchange rate condition of the radiator 4 is satisfied when both the vehicle speed VSP is higher than the vehicle speed criterion SL1 (prescribed speed) and the difference between the real coolant temperature Treal and the ambient air temperature TAN is larger than the temperature difference criterion SL2 (prescribed temperature difference). When such a method is used as in FIGS. 2E, 2F, 2G and 2H, the period during which the increased heat exchange rate condition of the radiator 4 is satisfied continuously is the period from t4' to t6' in FIGS. 2E, 2F, 2G and 2H. In this way, a diagnostic apparatus can be provided in which a determination as to whether or not a condition for conducting a thermostat stuck-open malfunction diagnosis of the thermostat 7 exists is made based on a temperature difference between a real cooling medium temperature and an ambient air temperature, i.e., in which a condition for conducting a thermostat stuck-open malfunction diagnosis of the thermostat 7 is determined to exist when the temperature difference between the real cooling medium temperature and the ambient air temperature is larger than a prescribed temperature difference.

When the first estimated coolant temperature Test1 is used, a real coolant temperature Treal occurring at a time t4' in FIGS. 2A and 2B is set as an initial temperature Tini. Then, starting from the time t4', a first relative temperature T1 (=Test1−Tini) is calculated by subtracting the initial temperature Tini from the first estimated coolant temperature Test1 and a second relative temperature T2 (=Treal−Tini) is calculated by subtracting the initial temperature Tini from the real coolant temperature Treal. A diagnosis of whether or not the thermostat 7 has malfunctioned (stuck-open) is accomplished based on which of the first relative temperature T1 and the second relative temperature T2 first exceeds a determination permission temperature criterion SL3 (fixed prescribed reference value). In other words, the thermostat diagnostic apparatus determines that the thermostat 7 has not malfunctioned (i.e., the thermostat 7 is normal and not stuck-open) if the second relative temperature T2 (=Treal−Tini) exceeds the determination permission temperature criterion SL3 (prescribed reference value) before the first relative temperature T1 (=Test1−Tini) and determines that the thermostat 7 has malfunctioned (stuck-open) if the first relative temperature T1 (=Test1−Tini) exceeds the determination permission temperature criterion SL3 before the second relative temperature T2 (=Treal−Tini).

More specifically, FIG. 2A shows how the real coolant temperature Treal changes when the thermostat 7 has a stuck-open malfunction and FIG. 2B shows how the real coolant temperature Treal changes when the thermostat 7 is normal. In FIG. 2A, the first relative temperature T1 (=Test1−Tini) exceeds the determination permission temperature criterion SL3 at a time t5' occurring before the second relative temperature T2 (=Treal−Tini) exceeds the determination permission temperature criterion SL3. Consequently, the thermostat 7 is diagnosed to have incurred a stuck-open malfunction at the time t5'. Conversely, in FIG. 2B, the second relative temperature T2 (=Treal−Tini) exceeds the determination permission temperature criterion SL3 at a time t5' occurring before the first relative temperature T1 (=Test1−Tini) exceeds the determination permission temperature criterion SL3. Consequently, the thermostat 7 is diagnosed not to have incurred a stuck-open malfunction (i.e., to be normal) at the time t5'.

Meanwhile, when the second estimated coolant temperature Test2 is used, a real coolant temperature Treal occurring at a time t4' in FIGS. 2C and 2D is set as an initial temperature Tini. Then, starting from the time t4', a third relative temperature T3 (=Test2−Tini) is calculated by subtracting the initial temperature Tini from the second estimated coolant temperature Test2 and a second relative temperature T2 (=Treal−Tini) is calculated by subtracting the initial temperature Tini from the real coolant temperature Treal. A diagnosis of whether or not the thermostat 7 has malfunctioned (stuck-open) is accomplished based on which of the third relative temperature T3 and the second relative temperature T2 first exceeds a determination permission temperature criterion SL3 (fixed prescribed reference value). In other words, the thermostat diagnostic apparatus determines that the thermostat 7 has not malfunctioned (i.e., the thermostat 7 is normal and not stuck-open) if the second relative temperature T2 (=Treal−Tini) exceeds the determination permission temperature criterion SL3 (prescribed reference value) before the third relative temperature T3 (=Test2−Tini) and determines that the thermostat 7 has malfunctioned (stuck-open) if the third relative temperature T3 (=Test1−Tini) exceeds the determination permission temperature criterion SL3 before the second relative temperature T2 (=Treal−Tini).

More specifically, FIG. 2C shows how the real coolant temperature changes when the thermostat 7 has a stuck-open malfunction and FIG. 2D shows how the real coolant temperature Treal changes when the thermostat 7 is normal. In FIG. 2C, the third relative temperature T3 (=Test2−Tini) exceeds the determination permission temperature criterion SL3 at a time t5' occurring before the second relative temperature T2 (=Treal−Tini) exceeds the determination permission temperature criterion SL3. Consequently, the thermostat 7 is diagnosed to have incurred a stuck-open malfunction at the time t5'. Meanwhile, in FIG. 2D, the second relative temperature T2 (=Treal−Tini) exceeds the determination permission temperature criterion SL3 at a time t5' occurring before the third relative temperature T3 (=Test2−Tini) exceeds the determination permission temperature criterion SL3. Consequently, the thermostat 7 is diagnosed not to have incurred a stuck-open malfunction (i.e., to be normal) at the time t5'.

Thus, in FIGS. 2A, 2B, 2C, and 2D, when the first estimated coolant temperature Test1 is used as the estimated coolant temperature, the statement "a stuck-open malfunction diagnosis of the thermostat 7 is conducted when either the real coolant temperature or the estimated coolant temperature exceeds a prescribed reference value" means that the thermostat 7 is diagnosed to have incurred a stuck-open malfunction if the first relative temperature T1 (=Test1−Tini) exceeds the prescribed reference value (determination permission temperature criterion SL3) before the second relative temperature T2 (=Treal−Tini) does and the thermostat 7 is diagnosed not to have incurred a stuck-open malfunction, i.e., to be normal, if the second relative temperature T2 (=Treal−Tini) exceeds the prescribed reference value (determination permission temperature criterion SL3) before the first relative temperature T1 (=Test1−Tini) does.

Meanwhile, when the second estimated coolant temperature Test1 is used as the estimated coolant temperature, the statement "a stuck-open malfunction diagnosis of the thermostat 7 is conducted when either the real coolant temperature Treal or the estimated coolant temperature exceeds a prescribed reference value" means that the thermostat 7 is diagnosed to have incurred a stuck-open malfunction if the third relative temperature T3 (=Test2−Tini) exceeds the prescribed reference value (determination permission temperature criterion SL3) before the second relative temperature T2 (=Treal−Tini) does and the thermostat 7 is diagnosed not to have incurred a stuck-open malfunction, i.e., to be normal, if the second relative temperature T2 (=Treal−Tini) exceeds the prescribed reference value (determination permission temperature criterion SL3) before the third relative temperature T3 (=Test2−Tini) does.

In FIGS. 2E, 2F, 2G and 2H, there is a tradeoff involved in using both the vehicle speed criterion SL1 and the temperature difference criterion SL2 for determining if the increased heat exchange rate condition of the radiator 4 is satisfied continuously. The period of time in which the increased heat exchange rate condition of the radiator 4 is satisfied continuously becomes longer when the vehicle speed criterion SL1 is lowered. Thus, although the opportunities for executing a diagnosis of whether or not the thermostat 7 has malfunctioned (stuck-open) increase, the actual heat exchange rate of the radiator 4 tends to decrease due to the lower vehicle speed criterion SL1 and the accuracy of the diagnosis declines. In order to compensate for the declined accuracy of the diagnosis, it is necessary to increase the temperature difference criterion SL2 such that the temperature difference between the real coolant temperature Treal and the ambient air temperature TAN is more clearly distinguishable for a normal thermostat versus a thermostat having a stuck-open malfunction. Conversely, the period of time in which the increased heat exchange rate condition of the radiator 4 is satisfied continuously becomes shorter when the vehicle speed criterion SL1 is raised. Thus, although the opportunities for executing a diagnosis decrease, the actual heat exchange rate of the radiator 4 tends to increase due to the higher vehicle speed criterion SL1 and the accuracy of the diagnosis improves. Since the accuracy of the diagnosis is improved, a normal thermostat can be clearly distinguished from a thermostat having a stuck-open malfunction even if the temperature difference between the real coolant temperature Treal and the ambient air temperature TAN is small and, thus, the temperature difference criterion SL2 can be smaller. Due to this tradeoff relationship between the vehicle speed criterion SL1 and the temperature difference criterion SL2, the vehicle speed criterion SL1 and the temperature difference criterion SL2 are ultimately determined using a matching method such that a good balance is obtained. The vehicle speed criterion SL1 serves solely to determine if the increased heat exchange rate condition of the radiator 4 is satisfied and a condition for executing a diagnosis according to the present thermostat diagnostic apparatus is never achieved in a low vehicle speed region.

With the present thermostat diagnostic apparatus, it is not necessary to wait until a prescribed amount of time has elapsed since the engine E was started or until the engine E reaches a prescribed warm-up state after being started in order to execute a diagnosis to determine if the thermostat 7 has malfunctioned (stuck-open) if a period in which an increased heat exchange rate condition of the radiator 4 is satisfied continuously occurs before then. During such a continuous period, a stuck-open failure of the thermostat 7 can be diagnosed when either the estimated coolant temperature Test1 or Test2 (estimated cooling medium temperature) or the real coolant temperature Treal (real cooling medium temperature) exceeds the determination permission temperature criterion SL3 (prescribed reference value).

The method of diagnosing the thermostat 7 executed by the engine controller 11 will now be explained based on a flowchart of FIG. 3.

Figure 3:
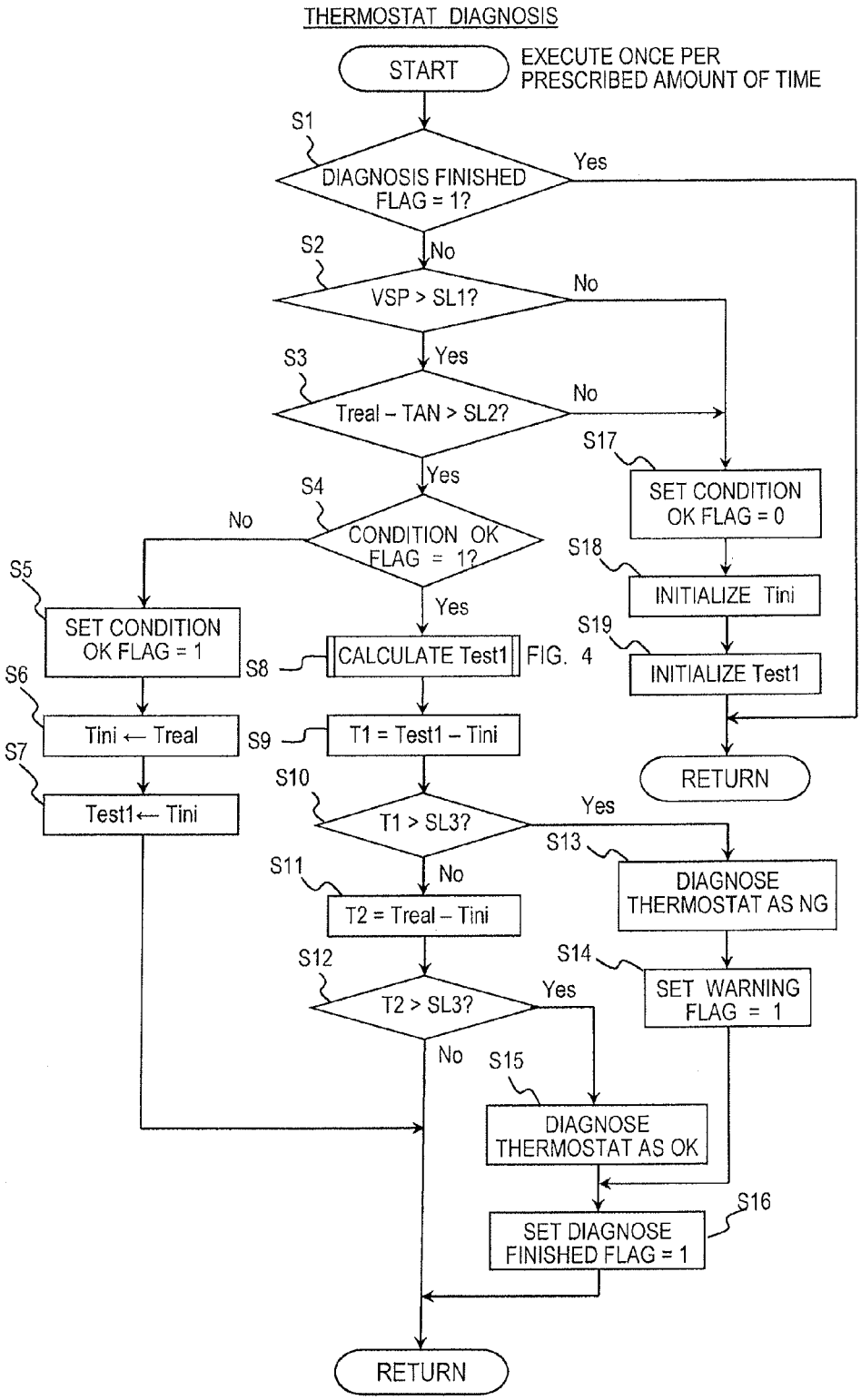
FIG. 3 is a flowchart for explaining a thermostat diagnosis according to the first embodiment.

FIG. 3 shows a flowchart for diagnosing the thermostat 7 according to the first embodiment using FIGS. 2A, 2B, 2C and 2D. The processing shown in the flowchart is executed once per prescribed time period (e.g., every 10 ms). In the first embodiment, the thermostat 7 is diagnosed based on the first estimated coolant temperature Test1 and the real coolant temperature Treal, which corresponds to the method of diagnosing the thermostat 7 shown in FIGS. 2A and 2B. A method of diagnosing the thermostat 7 based on the second estimated coolant temperature Test2 and the real coolant temperature Treal will be explained later based on FIG. 11.

In Step S1, the engine controller 11 checks a diagnosis finished flag. The diagnosis finished flag is initially set to zero when the engine E is started. In this embodiment, if the value of the diagnosis finished flag is 0, then the engine controller 11 proceeds to Step S2 where the engine controller 11 compares a vehicle speed VSP detected by the vehicle speed sensor 15 to a vehicle speed criterion SL1 (prescribed speed). The vehicle speed criterion SL1 is used to determine if an increased heat exchange rate condition of the radiator 4 is satisfied. The vehicle speed criterion SL1 is set to an optimum value by a matching method based on experimental data for a particular vehicle model. In FIGS. 2A and 2B, during a period from a time t1 until a moment immediately before a time t3, the vehicle speed VSP is equal to or smaller than the vehicle speed criterion SL1 and the engine controller 11 proceeds to Steps S17 to S19, where it sets a condition OK flag to 0 and initializes an initial temperature Tini and a first estimated coolant temperature Test1.

If the vehicle speed VSP is found to exceed the vehicle speed criterion SL1 in Step S2, the engine controller 11 determines that an increased heat exchange rate condition of the radiator 4 is satisfied and proceeds to Step S3. The timing at which the engine controller 11 proceeds to Step S3 corresponds to the time t3 in FIGS. 2A and 2B.

In Step S3, the engine controller 11 compares a value obtained by subtracting an ambient air temperature TAN from a real coolant temperature Treal (Treal−TAN) to a temperature difference criterion SL2 (prescribed temperature difference). The rear coolant temperature Treal is detected by the coolant temperature sensor 12 and the ambient air temperature TAN is detected by the ambient air temperature sensor 13. The temperature difference criterion SL2 is set in advance because it is used to determine if a diagnosis condition is satisfied. During a period spanning from a time t3 until a moment immediately before a time t4' in FIGS. 2A and 2B, the engine controller 11 proceeds to Steps S17 through S19 because the temperature difference (Treal−TAN) between the real coolant temperature Treal and the ambient air temperature TAN is equal to or smaller than the temperature difference criterion SL2.

If in Step S3 the temperature difference (Treal−TAN) between the real coolant temperature Treal and the ambient air temperature TAN is larger than the temperature difference criterion SL2, then the engine controller 11 determines that the diagnosis condition is satisfied and proceeds to Step S4. The satisfaction of the diagnosis condition occurs at a time corresponding to the time t4' in FIGS. 2A and 2B.

In Step S4, the engine controller 11 checks the condition OK flag (which is initially set to zero when the engine E is started). If the value of the condition OK flag is 0, then the engine controller 11 proceeds to Step S5 and sets the condition OK flag to 1 to indicate that the diagnosis condition has been satisfied.

In Steps S6 and S7, the engine controller 11 sets a real coolant temperature Treal corresponding to the time when the diagnosis condition was found to be satisfied as an initial temperature Tini to be used as an estimated coolant temperature and sets the value of the initial temperature Tini as the first estimated coolant temperature Test1.

The explanation will now be continued under the assumption that in subsequent control cycles the vehicle speed VSP remains larger than the vehicle speed criterion SL1 in Step S2 and the difference between the real coolant temperature Treal and the ambient air temperature TAN remains larger than the temperature difference criterion SL2 in Step S3. Since the condition OK flag has been set to 1 in Step S5, in subsequent control cycles the engine controller 11 proceeds from Step S4 to Step S8, where engine controller 11 calculates (updates) the first estimated coolant temperature Test1. The first estimated coolant temperature Test1 is a temperature used when a normal thermostat low estimated temperature is to be used as the estimated coolant temperature. The calculation of the first estimated coolant temperature Test1 will now be explained with reference to FIG. 4 (which shows a subroutine corresponding to Step S8 of FIG. 3).

Figure 4:
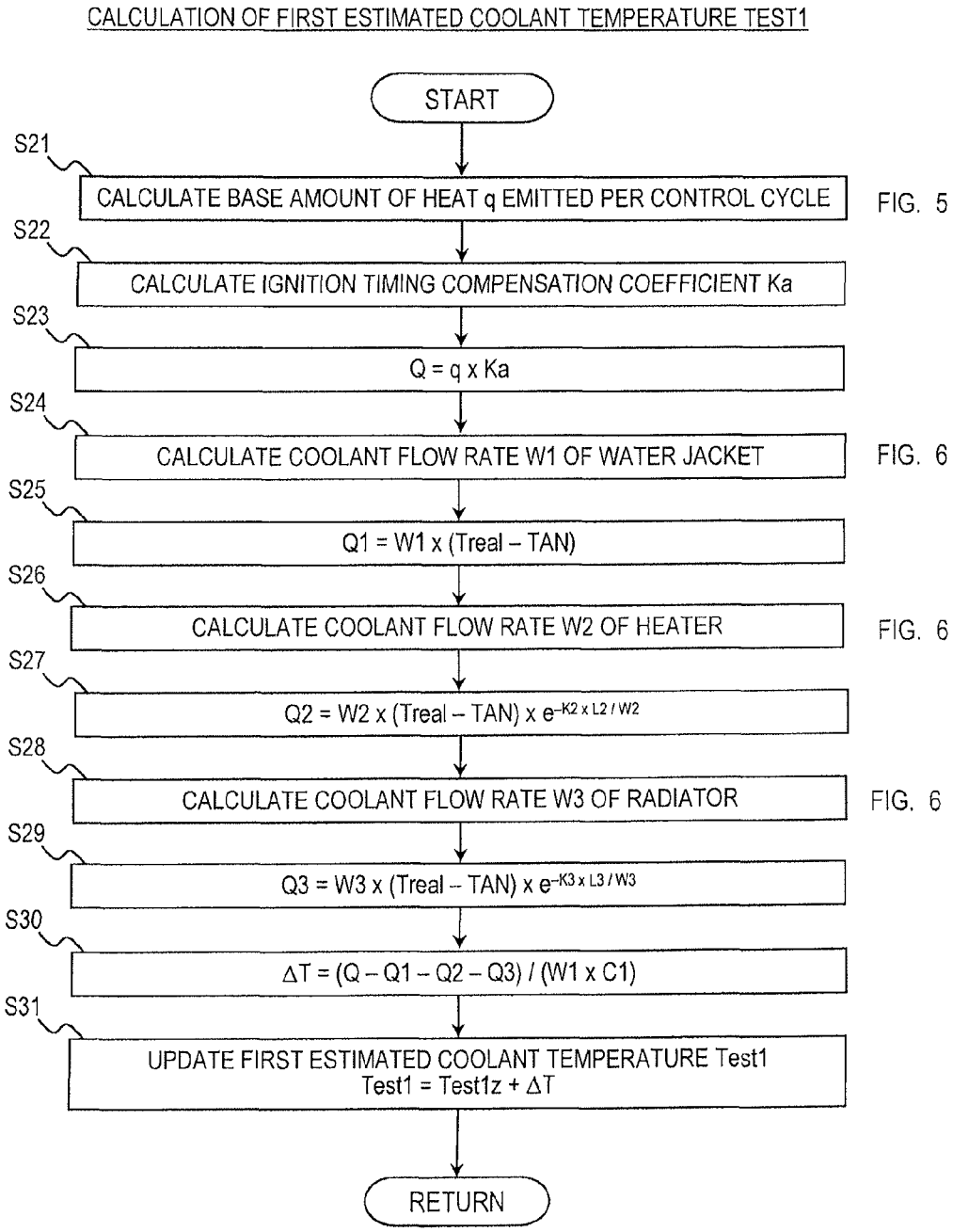
FIG. 4 is a flowchart for explaining a calculation of a first estimated coolant temperature according to the first embodiment.
Figure 5:
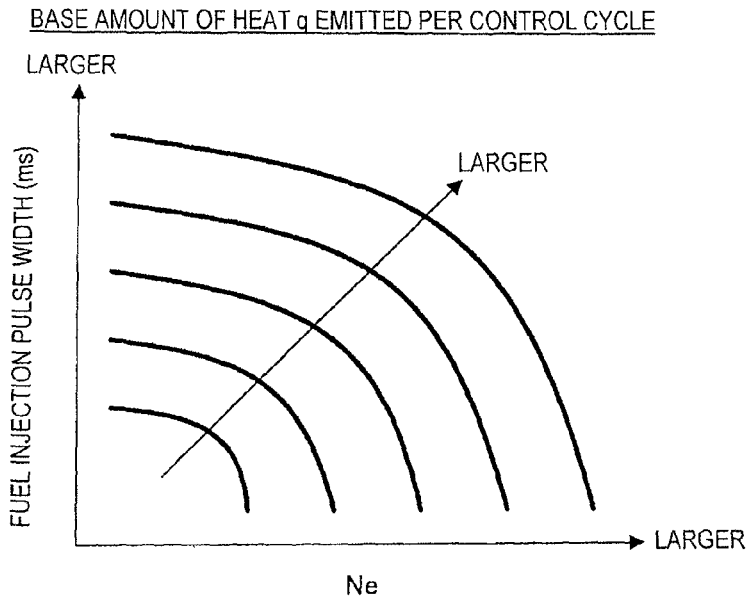
FIG. 5 is a characteristic diagram of a base heat emission amount per control cycle according to the first embodiment.

In Step S21 of FIG. 4, the engine controller 11 calculates a base generated heat amount q of the engine per control cycle (per 10-ms period) based on an engine rotational speed Ne and a fuel injection pulse width Ti using a map shown in FIG. 5. The base generated heat amount q per control cycle is an amount of heat generated from the engine per control cycle when the injection timing is set to a base injection timing (fixed value). The base generated heat amount q per control cycle is determined in advance by experimentation or the like and stored in memory of the engine controller 11. The engine controller 11 calculates the engine rotational speed Ne based on a crank angle detected by the crank angle sensor 14. The engine controller 11 calculates a fuel injection pulse width Ti and an ignition timing in accordance with a desired engine operating condition. When a prescribed fuel injection timing is reached, an injector (not shown) is opened for the duration of the fuel injection pulse width Ti and fuel is supplied to the engine E. When the ignition timing is reached, a spark plug (not shown) arranged to face toward a combustion chamber is operated to generate a spark for spark ignition. In this embodiment, the fuel injection pulse width Ti is also used as an engine load to calculate a base generated heat amount q of the engine per control cycle.

In Step S22, the engine controller 11 calculates an ignition timing compensation coefficient Ka by searching a prescribed table based on the aforementioned calculated ignition timing. In Step S23, the engine controller 11 multiplies the base generated heat amount q of the engine per control cycle by the ignition timing compensation coefficient Ka to obtain a heat generation rate Q of the engine per control cycle. That is, the heat generation rate Q of the heat generated by the engine per control cycle is calculated using the following equation.

$$Q=q\times Ka \tag{1}$$

The ignition timing compensation coefficient Ka is used to enable the generate heat amount of the engine per control cycle to be calculated accurately even when the ignition timing calculated based on an operating condition of the engine E is divergent from a base ignition timing. If the ignition timing is divergent from the base ignition timing, then the amount of heat generated from the engine per control cycle will deviate from an amount of heat generated from the engine per control cycle when the ignition timing is equal to the base ignition timing. For example, if the ignition timing is more advanced than the base ignition timing, then the combustion state will improve and the amount of heat generated from the engine per control cycle will be larger than the amount of heat that would be generated from the engine per control cycle if the base ignition timing were used. Thus, when the ignition timing is more advanced than the base ignition timing, a value larger than 1.0 is used as the ignition timing compensation coefficient Ka to obtain an generated heat amount per control cycle that is larger than the amount of heat that would be generated from the engine per control cycle if the base ignition timing were used and matches an actual amount of heat generated from the engine per control cycle.

Conversely, if the ignition timing is more retarded than the base ignition timing such as during cold starting, then the combustion state will degrade and the amount of heat generated from the engine per control cycle will be smaller than the amount of heat that would be generated from the engine per control cycle if the base ignition timing were used. Thus, when the ignition timing is more retarded than the base ignition timing, a value smaller than 1.0 is used as the ignition timing compensation coefficient Ka to obtain an generated heat amount per control cycle that is smaller than the amount of heat that would be generated from the engine per control cycle if the base ignition timing were used and matches an actual amount of heat generated from the engine per control cycle.

Figure 6:
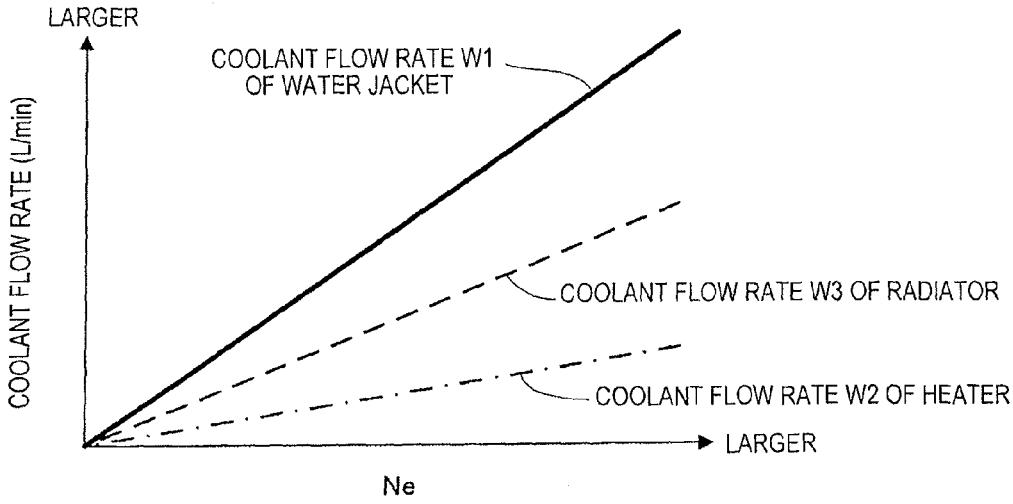
FIG. 6 is a characteristic diagram of coolant flow rates of a water jacket, a radiator, and a heater in the first embodiment.

In Step S24, the engine controller 11 calculates a coolant flow rate W1 of coolant flowing through the water jacket 2 based on the engine rotational speed Ne by searching a table of the content shown in FIG. 6. In Step S25, the engine controller 11 calculates a heat transfer rate Q1 of heat being dissipated from the water jacket 2 per control cycle based on the real coolant temperature Treal, the ambient air temperature TAN, and the coolant flow rate W1 using the equation shown below. In the equation, C1 is a specific heat (J/g° K) of the cylinder block.

$$Q1=W1\times C1(Treal-TAN) \tag{2}$$

In Step S26, the engine controller 11 calculates a coolant flow rate W2 of coolant flowing through the heater 9 based on the engine rotational speed Ne by searching a table of the content shown in FIG. 6. In Step S27, the engine controller 11 calculates a heat transfer rate Q2 of heat being dissipated from the heater 9 per control cycle based on the real coolant temperature Treal, the ambient air temperature TAN, and the coolant flow rate W2 using the equation shown below. In the equation, K2 is a heat transfer coefficient between the atmosphere and a surface of the heater 9 and L2 is a coolant flow passage length inside the heater 9.

$$Q2=W2(Treal-TAN)\times e^{(-K2\times L2/W2)} \tag{3}$$

In Step S28, the engine controller 11 calculates a coolant flow rate W3 of coolant flowing through the radiator 4 based on the engine rotational speed Ne by searching a table of the content shown in FIG. 6. In Step S29, the engine controller 11 calculates a heat transfer rate Q3 of heat being dissipated from the radiator 4 per control cycle based on the real coolant temperature Treal, the ambient air temperature TAN, and the coolant flow rate W3 using the equation shown below. In the equation, K3 is a heat transfer coefficient of a material forming an external surface of the radiator 4 and L3 is a coolant flow passage length inside the radiator 4.

$$Q3=W3(Treal-TAN)\times e^{(-K3\times L3/W3)} \tag{4}$$

In the equations (3) and (4), the temperature of the heater 9 and the temperature of the radiator 4 are both approximated with the real coolant temperature (Treal) at the water jacket outlet 2*b*. However, it is also acceptable to provide dedicated temperature sensors to actually detect a temperature of the heater 9 and a temperature of the radiator 4. In such a case, the detected temperature of the heater 9 can be used to calculate heat transfer rate Q2 of heat being dissipated from the heater 9 per control cycle and the detected temperature of the radiator 4 can be used to calculate heat transfer rate Q3 of heat being dissipated from the radiator 4 per control cycle.

In Step S30, the engine controller 11 uses the amount of heat Q generated from the engine per control cycle, heat transfer rate Q1 of heat being dissipated from the water jacket 2 per control cycle, heat transfer rate Q2 of heat being dissipated from the heater 9 per control cycle, and heat transfer rate Q3 of heat being dissipated from the radiator 4 per control cycle, each calculated as explained above, in the equation shown below to calculate a temperature increase amount ΔT of a coolant temperature per control cycle. In the equation, C1 is a specific heat of the cylinder block.

$$\Delta T=(Q-Q1-Q2-Q3)/(W1\times C1) \tag{5}$$

In step S31, the engine controller 11 calculates a sum of the temperature increase amount ΔT of a coolant temperature per control cycle and the first estimated coolant temperature Test1*z* of the previous cycle and sets the value of the sum as the value of the first estimated coolant temperature Test1, thereby updating (calculating) the first estimated coolant temperature Test1 using the equation shown below. In the equation, Test1*z* is the value of Test1 from the previous control cycle.

$$Test1=Test1z+\Delta T \tag{6}$$

After completing the calculation of the first estimated coolant temperature Test1, the engine controller 11 returns to FIG. 3 and sets a value obtained by subtracting the initial temperature Tini from the first estimated coolant temperature Test1 as a first relative temperature T1. In short, the engine controller 11 sets the first relative temperature T1 using the following equation.

$$T1=Test1-Tini \tag{7}$$

In Step S10, the engine controller 11 compares this first relative temperature T1 to a determination permission temperature criterion SL3 (prescribed reference value). The determination permission temperature criterion SL3 is a value set in advance for determining if the thermostat 7 has malfunctioned (stuck-open).

Immediately after the condition OK flag is set to 1, the engine controller 11 proceeds to Step S11 because the first relative temperature T1 is smaller than the determination permission temperature criterion SL3. In Step S11, the engine controller 11 sets a value obtained by subtracting the initial temperature Tini from the real coolant temperature Treal as a second relative temperature T2, i.e., calculates a second relative temperature T2 using the equation shown below.

$$T2=T\text{real}-T\text{ini} \quad (8)$$

In Step S12, the engine controller 11 compares this second relative temperature T2 to the determination permission temperature criterion SL3. Immediately after the condition OK flag is set to 1, the current cycle of the control sequence is ended because the second relative temperature T2 is smaller than the determination permission temperature criterion SL3.

In the subsequent control cycles, the engine controller 11 waits until the first relative temperature T1 (=Test1−Tini) and the second relative temperature T2 (=Treal−Tini) increase. That is, the engine controller 11 repeats Steps S8 to S12 until either the first relative temperature T1 is found to be larger than the determination permission temperature criterion SL3 in Step S10 or the second relative temperature T2 is found to be larger than the determination permission temperature criterion SL3 in Step S12.

If the first relative temperature T1 (=Test1−Tini) is found to be larger than the determination permission temperature criterion SL3 in Step S10, then the engine controller 11 proceeds to Step S13 and determines that the first estimated coolant temperature Test1 increased before the real coolant temperature Treal, thereby diagnosing that a stuck-open malfunction exists in the thermostat 7 (indicated as "NG" in the Figure). The timing of this diagnosis corresponds to a time t5' in FIG. 2A. In Step S13, the engine controller 11 stores the fact that the thermostat 7 has malfunctioned (stuck-open) in a memory and in Step S14 the engine controller 11 sets a warming flag to 1 (this warning flag is initially set to zero when the engine E is started). In a control sequence not shown in the figures, the fact that the value of the warning flag has changed to 1 is recognized and the alarm device 21 is operated to inform a driver that a stuck-open malfunction has occurred in the thermostat 7.

Meanwhile, if the second relative temperature T2 (=Treal−Tini) is found to be larger than the determination permission temperature criterion SL3 in Step S12, then the engine controller 11 proceeds to Step S15 and determines that the real coolant temperature Treal increased before the first estimated coolant temperature Test1, thereby diagnosing that a stuck-open malfunction does not exist in the thermostat 7 (i.e., the thermostat 7 is normal, indicated as "OK" in the figure). The timing of this diagnosis corresponds to a time t5' in FIG. 2B. In Step S15, the engine controller 11 stores the fact that a stuck-open malfunction has not occurred in the thermostat 7 (the thermostat 7 is normal) in the memory.

Finally, in Step S16, the engine controller 11 sets the diagnosis finished flag to 1 because the diagnosis of whether or not the thermostat 7 has malfunctioned (stuck-open) (thermostat stuck-open malfunction diagnosis) is complete. Once the value of the diagnosis finished flag has been set to 1, the engine controller 11 cannot proceed to Step S2 and beyond. In this way, the engine controller 11 is limited to executing only one diagnosis of whether or not the thermostat 7 has malfunctioned (stuck-open) after the engine E is started.

Meanwhile, if the engine controller 11 is in a state of proceeding to Steps S3 and beyond because the vehicle speed VSP is larger than the vehicle speed criterion SL1 and then subsequently the vehicle speed VSP becomes equal to or smaller than the vehicle speed criterion SL1 before the engine controller 11 reaches Step S13 or Step S15, then the engine controller 11 determines that the condition increased heat exchange rate of the radiator 4 is no longer satisfied and the engine controller 11 proceeds to Step S17, where it sets the condition OK flag to 0. Then, in Steps S18 and S19, the engine controller 11 initializes the initial temperature Tini and the first estimated temperature Test1 to prepare for the next opportunity to execute a diagnosis. Thus, when a period in which the increased heat exchange rate condition of the radiator 4 is satisfied continuously is interrupted before a diagnostic result can be obtained in Step S13 or Step S15, the diagnosis finished flag remains at 0 and the engine controller 11 executes another diagnosis of whether or not the thermostat 7 has malfunctioned (stuck-open) later by proceeding to Steps 3 and beyond when the vehicle speed VSP again exceeds the vehicle speed criterion SL1. In other words, until a diagnostic result is obtained in Step S13 or S15, the engine controller 11 executes a thermostat stuck-open diagnosis of whether or not the thermostat 7 has malfunctioned (stuck-open) every time a period occurs in which the increased heat exchange rate condition of the radiator 4 is satisfied continuously.

Operational effects of this embodiment will now be explained.

A conventional technology executes a diagnosis when a prescribed amount of time has elapsed or when a prescribed warm-up state is reached, but there are times when a condition that enables a diagnosis to be executed with improved accuracy occurs before a prescribed amount of time has elapsed or a prescribed warm-up state is reached. The present thermostat diagnostic apparatus was conceived based on the inventor's observation that during a period in which an increased heat exchange rate condition of a radiator 4 is satisfied continuously, an accurate diagnosis can be accomplished without waiting until a prescribed amount of time has elapsed since operation of the vehicle was started or the engine E reaches a prescribed warm-up state since operation of the vehicle was started.

In the embodiment, a diagnosis of whether or not the thermostat 7 has malfunctioned (stuck-open) (see Steps S10, S13, S12 or S15 of FIG. 3) is executed when either the first relative temperature T1 (=Test1−Tini) (estimated cooling medium temperature) or the second relative temperature T2 (=Treal−Tini) (real cooling medium temperature) exceeds the determination permission temperature criterion SL3 (prescribed reference value) during a period in which an increased heat exchange rate condition of the radiator 4 is satisfied continuously. As a result, a highly accurate diagnosis can be accomplished early, even during a period before a prescribed amount of time has elapsed since operation of the vehicle (mobile body) was started or during a period before the engine E has reached a prescribed warm-up state since operation of the vehicle (mobile body) was started.

Furthermore, with the conventional technology, there are times when a condition making it impossible to execute a diagnosis occurs right when the prescribed amount of time since operation of the vehicle was started or right when the engine F reaches a prescribed warm-up state since operation of the vehicle was started. Consequently, the present thermostat diagnostic apparatus also has the effect of increasing the frequency of diagnosis because it enables a diagnosis to be executed before the prescribed amount of time has elapsed or the prescribed warm-up state has been reached if a condition that improves the diagnosis accuracy is satisfied.

The amount of heat generated from the engine E is not necessarily relatively large when the vehicle speed VSP is relatively high, but it is reasonable to assume that the amount of heat generated from the engine E is often relatively large when the vehicle speed VSP is relatively high. Based on this assumption, this embodiment of the thermostat diagnostic apparatus is configured to determine if an increased heat exchange rate condition of the radiator 4 is satisfied based on the vehicle speed VSP (speed of the mobile body). More specifically, when the vehicle speed VSP is higher than a vehicle speed criterion SL1 (prescribed speed), it is determined that an increased heat exchange rate condition of the radiator 4 is satisfied (see Step S2 of FIG. 3). In this way, a period in which an increased heat exchange rate condition of the radiator 4 is satisfied can be identified easily without actually knowing a condition of the engine E.

In this embodiment, as seen in FIGS. 2E, 2F, 2G and 2H, a determination of an increased heat exchange rate condition of the radiator 4 being satisfied or not can be made based on a temperature difference between the real temperature Treal and the ambient air temperature TAN. If the temperature difference between the real temperature Treal and the ambient air temperature TAN is larger than a temperature difference criterion SL2 (prescribed temperature difference), then it is determined that an increased heat exchange rate condition of the radiator 4 is satisfied. In this way, even if the ambient air temperature TAN changes due to a condition of the surrounding environment or an operating condition of the vehicle V, an accurate determination can be made as to whether or not an increased heat exchange rate condition of the radiator 4 is satisfied.

In this embodiment, a determination as to whether or not a condition exists for diagnosing if the thermostat 7 has malfunctioned (stuck-open) is made based on a temperature difference between the real temperature Treal and the ambient air temperature TAN. If the temperature difference between the real temperature Treal and the ambient air temperature TAN is larger than a temperature difference criterion SL2 (prescribed temperature difference), then it is determined that a condition for diagnosing if the thermostat 7 has malfunctioned (stuck-open) is satisfied (see Step S3 of FIG. 3). In this way, even if the ambient air temperature TAN changes due to a condition of the surrounding environment or an operating condition of the vehicle V, an accurate determination can be made as to whether or not a condition for diagnosing if the thermostat 7 has malfunctioned (stuck-open) exists.

With this embodiment, if an increased heat exchange rate condition of the radiator 4 is interrupted before the thermostat 7 is diagnosed for a stuck-open malfunction, then the thermostat 7 is diagnosed for a stuck-open malfunction afterwards when either the first relative temperature T1 (estimated cooling medium temperature) or the second relative temperature T2 (real cooling medium temperature) exceeds the determination permission temperature difference criterion SL3 (prescribed reference value) during a period in which an increased heat exchange rate condition of the radiator 4 is satisfied continuously.

Figure 11:
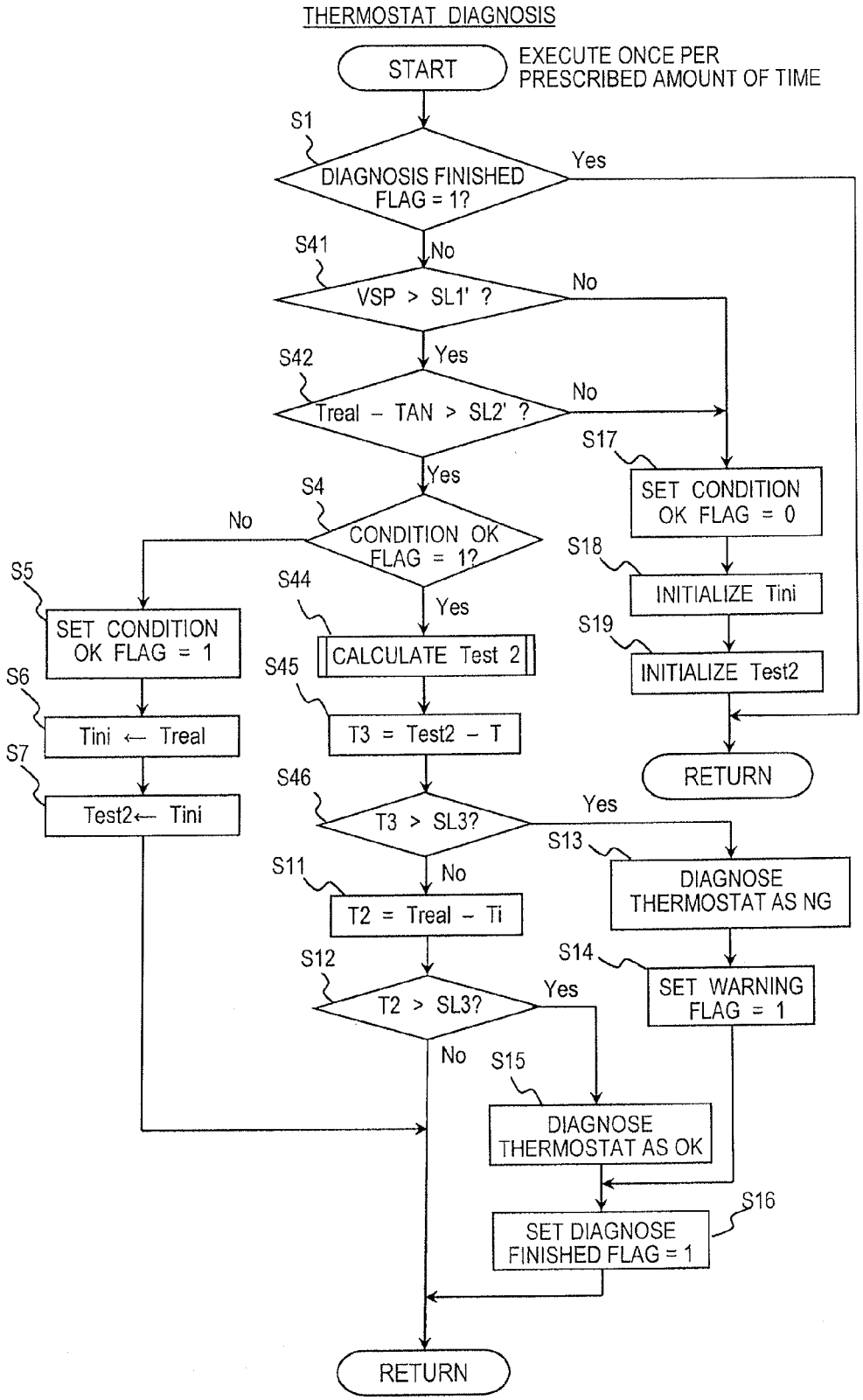
FIG. 11 is a flowchart for explaining a thermostat diagnosis according to a second embodiment.

FIG. 11 shows a flowchart for diagnosing a thermostat 7 according to the second embodiment. The processing shown in the flowchart is executed once per prescribed time period (e.g., every 10 ms). Steps that are the same as the steps of the first embodiment shown in FIG. 3 are indicated with the same step numbers. In the second embodiment, the thermostat 7 is diagnosed based on a second estimated coolant temperature Test2 and a real coolant temperature Treal, which corresponds to the thermostat diagnosis method shown in FIGS. 2C and 2D.

Figure 12:
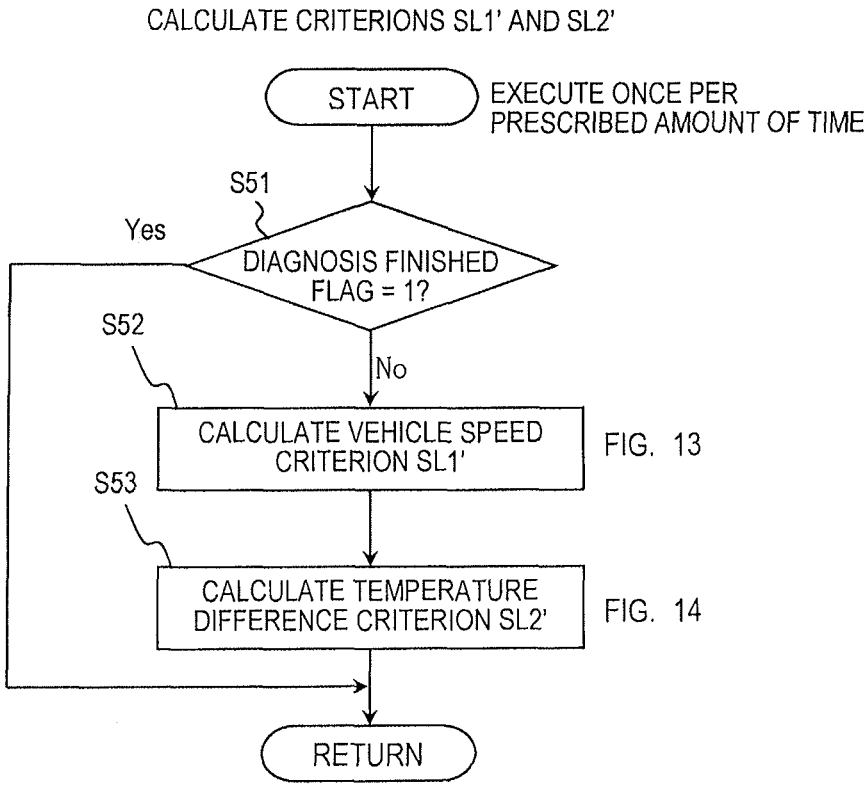
FIG. 12 is a flowchart for explaining a calculation of a vehicle speed criterion and a temperature difference criterion according to the second embodiment.

The second embodiment differs from the first embodiment in that it employs a vehicle speed criterion SL1' that varies depending on the engine rotational speed Ne and a temperature difference criterion SL2' that varies depending on the engine rotational speed Ne. FIG. 12 shows a flowchart for calculating the vehicle speed criterion SL1' that varies depending on the engine rotational speed Ne and the temperature difference criterion SL2' that varies depending on the engine rotational speed Ne. This flowchart, too, is executed once per prescribed time period (e.g., every 10 ms). The steps of the flowchart shown in FIG. 12 are executed before the steps of the flowchart shown in FIG. 11 due to the relationship of the steps.

In Step S51 of FIG. 12, the engine controller 11 checks a diagnosis finished flag. The diagnosis finished flag is initially set to zero when the engine is started. Assuming the value of the diagnosis finished flag is 0, the engine controller 11 proceeds to Step S52 where it calculates a vehicle speed criterion SL1' based on the engine rotational speed Ne at that time by searching a table of the content shown in FIG. 13. Then, in Step S53, the engine controller 11 calculates a temperature difference criterion SL2' based on the engine rotational speed Ne at that time by searching a table of the content shown in FIG. 14.

Figure 13:
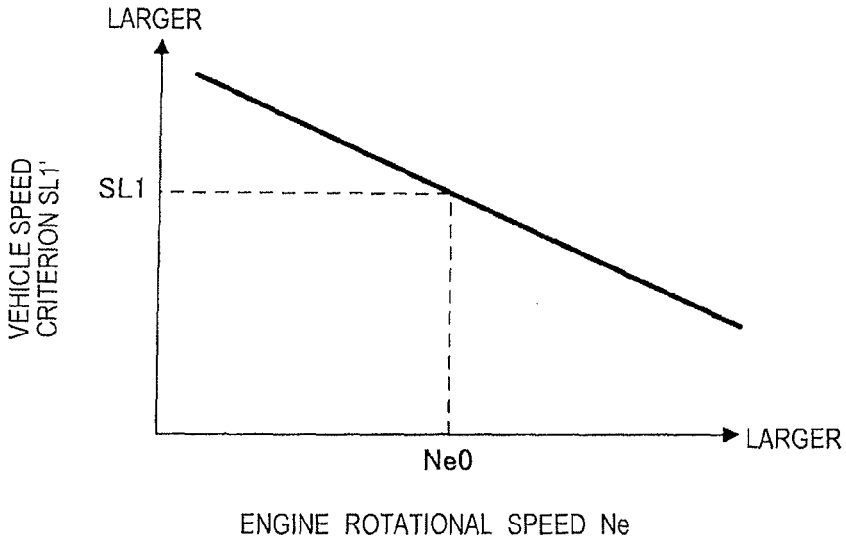
FIG. 13 is a characteristic diagram of a vehicle speed criterion according to the second embodiment.

As shown in FIG. 13, in a region where the engine rotational speed Ne is larger than a prescribed reference value rotational speed Ne0, the vehicle speed criterion SL1' is smaller than a vehicle speed criterion SL1 corresponding to the prescribed reference value rotational speed Ne0 and decreases as the engine rotational speed Ne increases. Meanwhile, in a region where the engine rotational speed Ne is smaller than the prescribed reference value rotational speed Ne0, the vehicle speed criterion SL1' is larger than the vehicle speed criterion SL1 corresponding to the prescribed reference value rotational speed Ne0.

Figure 14:
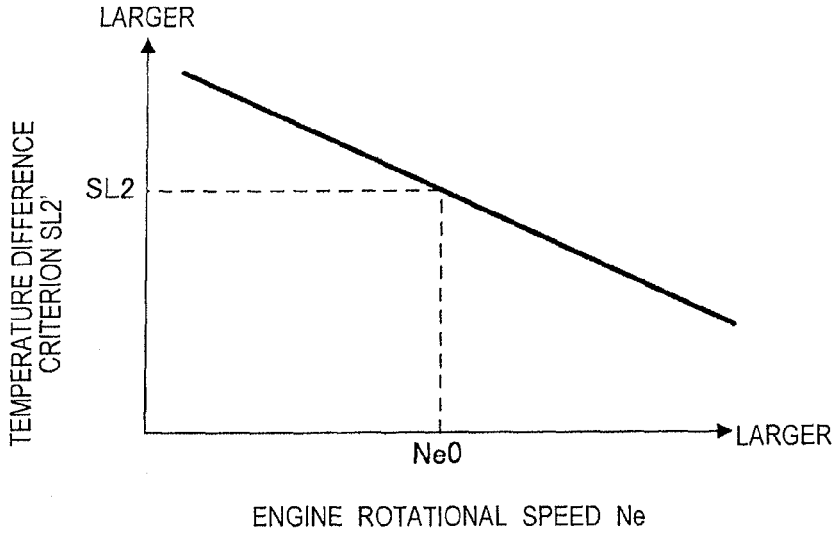
FIG. 14 is a characteristic diagram of a temperature difference criterion according to the second embodiment.

As shown in FIG. 14, in a region where the engine rotational speed Ne is larger than a prescribed reference value rotational speed Ne0, the vehicle speed criterion SL2' is smaller than a vehicle speed criterion SL2 corresponding to the prescribed reference value rotational speed Ne0 and decreases as the engine rotational speed Ne increases. Meanwhile, in a region where the engine rotational speed Ne is smaller than the prescribed reference value rotational speed Ne0, the vehicle speed criterion SL2' is larger than the vehicle speed criterion SL2 corresponding to the prescribed reference value rotational speed Ne0.

A vehicle speed criterion SL1' and a temperature difference criterion SL2' obtained as described above are stored in a memory to be used in FIG. 11.

Using FIG. 11, the second embodiment will now be explained focusing chiefly on the differences with respect to the first embodiment explained in FIG. 3. If the value of the diagnosis finished flag is 0, then the engine controller 11 proceeds to Step S41 and compares a vehicle speed VSP detected by the vehicle speed sensor 15 to a vehicle speed criterion SL1' calculated in Step S52 of FIG. 12. If the vehicle speed VSP is found to exceed the vehicle speed criterion SL1', the engine controller 11 determines that an increased heat exchange rate condition of the radiator 4 is satisfied and proceeds to Step S42.

In Step S42, the engine controller 11 compares a value obtained by subtracting an ambient air temperature TAN from a real coolant temperature Treal (Treal−TAN) to a temperature difference criterion SL2' calculated in Step S53 of FIG. 12. If the temperature difference (Treal−TAN) between the real coolant temperature Treal and the ambient air temperature TAN is larger than the temperature difference criterion SL2', then the engine controller 11 determines that a condition for diagnosis is satisfied and proceeds to Step S4.

After the condition OK flag is set to 1 in Step S5, in Steps S6 and S43 the engine controller 11 sets a real coolant temperature Treal corresponding to the time when the diagnosis condition was found to be satisfied as an initial temperature Tini to be used as an estimated coolant temperature and sets the value of the initial temperature Tini as the second estimated coolant temperature Test2.

The explanation will now be continued under the assumption that in subsequent control cycles the vehicle speed VSP remains larger than the vehicle speed criterion SL1' in Step S41 and the difference between the real coolant temperature Treal and the ambient air temperature TAN remains larger than the temperature difference criterion SL2' in Step S42. Since the condition OK flag has been set to 1 in Step S5, in subsequent control cycles the engine controller 11 proceeds from Step S4 to Step S44, where it calculates the second estimated coolant temperature Test2. The second estimated coolant temperature Test2 is a temperature used when a stuck-open thermostat high estimated temperature is to be used as the estimated coolant temperature. The method of calculating the second estimated coolant temperature Test2 is basically the same as the method of calculating the first estimated coolant temperature Test1. Similarly to the first estimated coolant temperature Test1, the second estimated coolant temperature Test2 is calculated using a base generated heat amount q per control cycle and coolant flow rates W1, W2, and W3. Although not shown in the figures, these quantities are calculated using characteristics similar to those shown in FIGS. 5 and 6 and used to calculate the second estimated coolant temperature Test2 in the same manner as for the first estimated coolant temperature Test1.

In Step S45, the engine controller 11 calculates a third relative temperature T3 by subtracting the initial temperature Tini from the second estimated coolant temperature Test2 calculated in Step S44, i.e., calculates a third relative temperature T3 using the equation shown below.

$$T3=\text{Test2}-T\text{ini} \tag{9}$$

In Step S46, the engine controller 11 compares this third relative temperature T3 to a determination permission temperature criterion SL3 (prescribed reference value). The determination permission temperature criterion SL3 is a value set in advance for determining if the thermostat 7 has malfunctioned (stuck-open).

Immediately after the condition OK flag is set to 1, the engine controller 11 proceeds to Step S11 because the third relative temperature T3 is smaller than the determination permission temperature criterion SL3. In Step S11, the engine controller 11 sets a value obtained by subtracting the initial temperature Tini from the real coolant temperature Treal as a second relative temperature T2, i.e., calculates a second relative temperature T2 using the equation shown below.

$$T2=T\text{real}-T\text{ini} \tag{10}$$

In Step S12, the engine controller 11 compares this second relative temperature T2 to the determination permission temperature criterion SL3. Immediately after the condition OK flag is set to 1, the current cycle of the control sequence is ended because the second relative temperature T2 is smaller than the determination permission temperature criterion SL3.

In the subsequent control cycles, the engine controller 11 waits until the third relative temperature T3 (=Test2−Tini) and the second relative temperature T2 (=Treal−Tini) increase. That is, the engine controller 11 repeats Steps S44, S45, S46, S11, and S12 until either the third relative temperature T3 is found to be larger than the determination permission temperature criterion SL3 in Step S46 or the second relative temperature T2 is found to be larger than the determination permission temperature criterion SL3 in Step S12.

If the third relative temperature T3 (=Test1−Tini) is found to be larger than the determination permission temperature criterion SL3 in Step S46, then the engine controller 11 proceeds to Step S13 and determines that the second estimated coolant temperature Test2 increased before the real coolant temperature Treal did, thereby diagnosing that a stuck-open malfunction exists in the thermostat 7. In Step S13, the engine controller 11 stores the fact that the thermostat 7 has malfunctioned (stuck-open) in a memory and in Step S14 the engine controller 11 sets a warming flag to 1 (this warning flag is initially set to zero when the engine is started). In a control sequence not shown in the figures, the fact that the value of the warning flag has changed to 1 is recognized and the alarm device 21 is operated to inform a driver that a stuck-open malfunction has occurred in the thermostat 7.

Meanwhile, if the second relative temperature T2 (=Treal−Tini) is found to be larger than the determination permission temperature criterion SL3 in Step S12, then the engine controller 11 proceeds to Step S15 and determines that the real coolant temperature Treal increased before the second estimated coolant temperature Test2, thereby diagnosing that a stuck-open malfunction does not exist in the thermostat 7 (i.e., the thermostat 7 is normal). In Step S15, the engine controller 11 stores the fact that a stuck-open malfunction has not occurred in the thermostat 7 (the thermostat 7 is normal) in the memory.

Finally, in Step S16, the engine controller 11 sets the diagnosis finished flag to 1 because the diagnosis of whether or not the thermostat 7 has malfunctioned (stuck-open) is complete. While the value of the diagnosis finished flag is 1, the engine controller 11 cannot proceed from Step S1 to Step S41 and beyond.

Meanwhile, if the engine controller 11 is in a state of proceeding to Steps S42 and beyond because the vehicle speed VSP is larger than the vehicle speed criterion SL1' and then subsequently the vehicle speed VSP becomes equal to or smaller than the vehicle speed criterion SL1' before the engine controller 11 reaches Step S13 or Step S15, then the engine controller 11 determines that the condition increased heat exchange rate of the radiator 4 is no longer satisfied and proceeds to Step S17, where it sets the condition OK flag to 0. Then, in Steps S18 and S47, the engine controller 11 initializes the initial temperature Tini and the second estimated temperature Test2 to prepare for the next opportunity to execute a diagnosis. Thus, when a period in which an increased heat exchange rate condition of the radiator 4 is satisfied continuously is interrupted before a diagnostic result can be obtained in Step S13 or Step S15, the diagnosis finished flag remains at 0 and the engine controller 11 executes another diagnosis of whether or not the thermostat 7 has malfunctioned (stuck-open) later by proceeding from Step S41 to Step S42 and beyond when the vehicle speed VSP again exceeds the vehicle speed criterion SL1'. In other words, until a diagnostic result is obtained in Step S13 or S15, the engine controller 11 executes a diagnosis of whether or not the thermostat 7 has malfunctioned (stuck-open) (a thermostat stuck-open diagnosis) every time a period occurs in which an increased heat exchange rate condition of the radiator 4 is satisfied continuously.

Operational effects of the second embodiment will now be explained.

The vehicle speed criterion SL1 and the temperature difference criterion SL2 (Steps S2 and S3 of FIG. 3) used in the first embodiment are optimized for the prescribed reference value rotational speed Ne0 (a fixed value). More specifically, if the heat exchange rate of the radiator 4 is assumed to be a prescribed value A when the engine rotational speed Ne equals the prescribed reference value rotational speed Ne0, then, in the first embodiment, a condition of the heat exchange rate of the radiator 4 being larger than the prescribed value A is determined to be satisfied whenever the vehicle speed VSP is larger than the vehicle speed criterion SL1, regardless of the actual current engine rotational speed of the engine E. Furthermore, if a temperature difference between the real coolant temperature Treal and the ambient air temperature TAN is assumed to be a prescribed value B when the engine rotational speed equals the prescribed reference value rotational speed Ne0, then, in the first embodiment, the difference between the real coolant temperature Treal and the ambient air temperature TAN is determined to be larger than the prescribed value B (i.e., the condition for executing a diagnosis is determined to be satisfied) whenever the temperature difference between the real coolant temperature Treal and the ambient air temperature TAN (=Treal−TAN) is larger than the temperature difference criterion SL2—regardless of engine rotational speed.

However, in actual practice, the heat exchange rate of the radiator 4 and the real coolant temperature Treal do depend on the engine rotational speed Ne. The higher the engine rotational speed Ne is, the larger the circulation rate of the coolant is and thus the larger the heat exchange rate of the radiator 4 is. Consequently, the real coolant temperature Treal increases. The heat exchange rate of the radiator 4 is larger than the aforementioned prescribed value A when the engine rotational speed Ne is higher than the prescribed reference value rotational speed Ne0, and the temperature difference between the real coolant temperature Treal and the ambient air temperature TAN is larger than the prescribed value B when the engine rotational speed Ne is higher than the prescribed reference value rotational speed Ne0. If a vehicle speed criterion SL1 that is optimum when the engine rotational speed Ne equals the prescribed reference value rotational speed Ne0 is used when the engine rotational speed Ne is higher than the prescribed reference value rotational speed Ne0, then the vehicle speed criterion SL1 obtained will be too high. If the vehicle speed criterion is too high, then there will be times when an increased heat exchange rate condition of the radiator 4 is not determined to exist even though an increased heat exchange rate condition of the radiator 4 could feasibly be determined to exist. Consequently, opportunities for determining that an increased heat exchange rate condition of the radiator 4 is satisfied will be missed.

In the second embodiment, however, a vehicle speed criterion SL1' that varies in response to the engine rotational speed Ne is used. That is, in the second embodiment (claim 3), since the vehicle speed criterion SL1' (prescribed speed) decreases as the engine rotational speed Ne increases (see FIG. 13), opportunities to determine that an increased heat exchange rate condition of the radiator 4 is satisfied are not missed when the engine rotational speed Ne is larger than the prescribed reference value rotational speed Ne0 (i.e., in a region where the engine rotational speed Ne is relatively high). As a result, in a region where the engine rotational speed Ne is larger than the prescribed reference value rotational speed Ne0, a longer period can be obtained in which an increased heat exchange rate condition of the radiator 4 is satisfied continuously.

If a temperature difference criterion SL2 that is optimum when the engine rotational speed Ne equals the prescribed reference value rotational speed Ne0 is used when the engine rotational speed Ne is higher than the prescribed reference value rotational speed Ne0, then the temperature difference criterion SL2 obtained will be too high. If the temperature difference criterion SL2 is too high, then there will be times when a condition for executing a diagnosis is not determined to exist even though a condition for executing a diagnosis could feasibly be determined to exist. Consequently, a determination that a condition for executing a diagnosis is satisfied will occur late.

In the second embodiment, however, a temperature difference criterion SL2' that varies in response to the engine rotational speed Ne is used. That is, in the second embodiment (claim 6), since the temperature difference criterion SL2' (prescribed temperature difference) decreases as the engine rotational speed Ne increases (see FIG. 14), a determination that a condition for executing a diagnosis is satisfied can be achieved earlier when the engine rotational speed Ne is larger than the prescribed reference value rotational speed Ne0 (i.e., in a region where the engine rotational speed Ne is relatively high). By satisfying a condition for executing a diagnosis earlier in a region where the engine rotational speed Ne is larger than the prescribed reference value rotational speed Ne0, completion of a diagnosis can also be achieved earlier.

The first embodiment exemplifies a case in which a thermostat 7 is diagnosed based on a first estimated coolant temperature Test1 and a real coolant temperature Treal, the second embodiment exemplifies a case in which a thermostat 7 is diagnosed based on a second estimated coolant temperature Test2 and a real coolant temperature Treal. It is also feasible to contrive an embodiment that combines these two embodiments.

The method of diagnosing the thermostat 7 is not limited to the methods shown in FIGS. 2A to 2H, 7, 8, 9, and 10. For example, the thermostat diagnostic apparatus could be configured to calculate a slope of the first estimated coolant temperature Test1 and a slope of a real coolant temperature Treal starting from a time t4' in FIGS. 2A and 2B or FIGS. 2E and 2F corresponding to when a condition for executing a diagnosis is satisfied and compare the two calculated slopes. The thermostat 7 could then be diagnosed to have a stuck-open malfunction if the slope of the first estimated coolant temperature Test1 is determined to be sufficiently larger than the slope of the rear coolant temperature Treal (or if a difference between the slope of first estimated coolant temperature Test1 and the slope of the real estimated temperature Treal exceeds a prescribed value), and the thermostat 7 could be diagnosed not to have a stuck-open malfunction (i.e., to be normal) if the slope of the rear coolant temperature Treal is determined to be sufficiently larger than the slope of the first estimated coolant temperature Test1 (or if a difference between the slope of the real estimated temperature Treal exceeds a prescribed value and the slope of the first estimated coolant temperature Test1).

Similarly, the thermostat diagnostic apparatus could be configured to calculate a slope of the second estimated coolant temperature Test2 and a slope of a real coolant temperature Treal starting from a time t4' in FIGS. 2C and 2D or FIGS. 2G and 2H corresponding to when a condition for executing a diagnosis is satisfied and compare the two calculated slopes. The thermostat 7 could then be diagnosed to have a stuck-open malfunction if the slope of the second estimated coolant temperature Test2 is determined to be sufficiently larger than the slope of the rear coolant temperature Treal (or if a difference between the slope of second estimated coolant temperature Test2 and the slope of the real estimated temperature Treal exceeds a prescribed value), and the thermostat 7 is diagnosed not to have a stuck-open malfunction (i.e., to be normal) if the slope of the rear coolant temperature Treal is determined to be sufficiently larger than the slope of the second estimated coolant temperature Test2 (or if a difference between the slope of the real estimated temperature Treal exceeds a prescribed value and the slope of the second estimated coolant temperature Test2).

In the embodiments, the condition for executing a diagnosis is determined to be satisfied when the vehicle speed VSP exceeds a vehicle speed criterion (SL1 and SL1') and a temperature difference between a real coolant temperature Treal and an ambient air temperature TAN exceeds a temperature difference criterion (SL2 or SL2'). However, the thermostat diagnostic apparatus is not limited to this method of determining the timing at which these conditions for a diagnosis is satisfied. For example, the thermostat diagnostic apparatus can be configured such that the larger the heat exchange rate of the radiator 4 is beyond the prescribed value A, the shorter an amount of time until the condition for executing a diagnosis is set. When the amount of time has elapsed, the condition for executing a diagnosis is determined to be satisfied and a diagnosis as to whether or not the thermostat 7 has malfunctioned (stuck-open) is executed based on a first estimated coolant temperature Test1 and the real coolant temperature Treal or based on a second estimated coolant temperature Test2 and the real coolant temperature Treal. As a result, the time required to obtain a diagnosis result can be shortened.

In order to shorten the time until a condition for executing a diagnosis is satisfied in accordance with an amount by which the heat exchange rate of the radiator 4 exceeds the prescribed value A, a table of increment amounts ΔCNT of a counter is prepared such that the increment amount ΔCNT increases as a diagnosis accuracy increases. The diagnosis accuracy improves as the vehicle speed VSP increases after exceeding the vehicle speed criterion SL1, as the temperature difference between the real coolant temperature Treal and the ambient air temperature TAN increases after exceeding the temperature difference criterion SL2, and as the engine rotational speed Ne increases above the prescribed reference value rotational speed Ne0. Therefore, the table of increment amounts ΔCNT for the counter can be set, for example, in any of the following ways.

1) The table can be set such that the increment amount ΔCNT of the counter increases as an amount by which vehicle speed VSP exceeds the vehicle speed criterion SL1 increases.

2) The table can be set such that the increment amount ΔCNT of the counter increases as an amount by which the temperature difference between the real coolant temperature Treal and the ambient air temperature TAN exceeds the temperature difference criterion SL2 increases.

3) The table can be set such that the increment amount ΔCNT of the counter increases as an amount by which the engine rotational speed Ne exceeds the prescribed reference value rotational speed Ne0 increases.

A counter increment amount ΔCNT is then be calculated by searching the corresponding table based on the vehicle speed VSP, the temperature difference between the real coolant temperature Treal and the ambient air temperature TAN, or the engine rotational speed Ne at that particular time, and a counter value CNT for the current control cycle is calculated by adding the counter increment amount ΔCNT to a counter value from a previous control cycle. In other words, the counter value CNT is calculated using the equation shown below, where VNTz is a counter value CNT from the previous control cycle.

$$CNT=CNTz+\Delta CNT \quad (11)$$

By comparing the calculated counter value CNT to a prescribed value CNT0 (prescribed value), the condition for executing a diagnosis can be determined to be satisfied when the counter value CNT is equal to or larger than the prescribed value CNT0.

In FIGS. 2A, 2B, 2C, 2D, 7, 8, 9, and 10, the real coolant temperature Treal and the ambient air temperature TAN are the same at a time (t1) when the engine E is started. That is, the embodiments were explained based on an assumption that the engine E was in a cold state before it was started. However, the thermostat diagnostic apparatus is not limited to such a situation and can also be employed when the engine E is warm before being started (e.g., when the engine E is restarted after having been stopped briefly).

While only selected embodiments have been chosen to illustrate the present invention, it will be apparent to those skilled in the art from this disclosure that various changes and modifications can be made herein without departing from the scope of the invention as defined in the appended claims. For example, the size, shape, location or orientation of the various components can be changed as needed and/or desired. Components that are shown directly connected or contacting each other can have intermediate structures disposed between them. The functions of one element can be performed by two, and vice versa. The structures and functions of one embodiment can be adopted in another embodiment. It is not necessary for all advantages to be present in a particular embodiment at the same time. Every feature which is unique from the prior art, alone or in combination with other features, also should be considered a separate description of further inventions by the applicant, including the structural and/or functional concepts embodied by such feature(s). Thus, the foregoing descriptions of the embodiments according to the present invention are provided for illustration only, and not for the purpose of limiting the invention as defined by the appended claims and their equivalents.

What is claimed is:

1. A thermostat diagnostic apparatus comprising:

a cooling medium temperature sensor;

an engine operating condition sensor; and a malfunction diagnosing device configured to conduct a thermostat stuck-open malfunction diagnosis of a thermostat provided in a coolant flow passage of an engine installed in a mobile body based on a comparison of a real cooling medium temperature detected by the cooling medium temperature sensor and an estimated cooling medium temperature estimated based on an engine operating condition of the engine detected by the engine operating condition sensor, the malfunction diagnosing device determining that the thermostat is stuck in an open state upon determining that either the estimated cooling medium temperature or the real cooling medium temperature exceeds a prescribed reference value during a period in which an increased heat exchange rate condition of a radiator is satisfied continuously;

the malfunction diagnosing device being configured to determine that the increased heat exchange rate condition of the radiator is satisfied based on a prescribed speed of the mobile body such that the increased heat exchange rate condition of the radiator is determined to be satisfied when a speed of the mobile body is higher than the prescribed speed, and the malfunction diagnosing device being further configured to variably set the prescribed speed based on an engine rotational speed of the engine such that as the engine rotational speed becomes higher, the prescribed speed is set to a smaller value.

2. The thermostat diagnostic apparatus as set forth in claim 1, wherein the malfunction diagnosing device is further configured to determine that the increased heat exchange rate condition of the radiator is satisfied based on a temperature difference between the real cooling medium temperature and an ambient air temperature such that the increased heat exchange rate condition of the radiator is determined to be satisfied upon the temperature difference between the real cooling medium temperature and the ambient air temperature being larger than a prescribed temperature difference.

3. The thermostat diagnostic apparatus as set forth in claim 2, wherein the malfunction diagnosing device is further configured to variably set the prescribed temperature difference based on an engine rotational speed of the engine such that as the engine rotational speed becomes higher, the temperature difference is set to a smaller value.

4. A thermostat diagnostic method comprising:

detecting a real cooling medium temperature of a coolant medium of an engine installed in a mobile body;

detecting an engine operating condition of the engine installed in the mobile body;

diagnosing a stuck-open malfunction of a thermostat provided in a coolant flow passage of the engine installed in the mobile body based on a comparison of the real cooling medium temperature that was detected and an estimated cooling medium temperature estimated based on the engine operating condition of the engine that was detected;

determining that the thermostat is stuck in an open state upon determining that either the estimated cooling medium temperature or the real cooling medium temperature exceeds a prescribed reference value during a period in which an increased heat exchange rate condition of a radiator is satisfied continuously, the increased heat exchange rate condition of the radiator being satisfied upon determining a speed of the mobile body is higher than a prescribed speed of the mobile body; and variably setting the prescribed speed based on an engine rotational speed of the engine such that as the engine rotational speed becomes higher, the prescribed speed is set to a smaller value.

5. The thermostat diagnostic method as set forth in claim 4, further comprising determining the increased heat exchange rate condition of the radiator is satisfied upon determining a temperature difference between the real cooling medium temperature and an ambient air temperature is larger than a prescribed temperature difference.

6. The thermostat diagnostic method as set forth in claim 5, wherein variably setting the prescribed temperature difference based on an engine rotational speed of the engine such that as the engine rotational speed becomes higher, the prescribed temperature is set to a smaller value.

* * * * *